US011458724B2

(12) United States Patent
Gamm et al.

(10) Patent No.: US 11,458,724 B2
(45) Date of Patent: Oct. 4, 2022

(54) SYSTEM AND METHOD FOR CONTROLLING COLOR CHARACTERISTICS OF A PRINTED IMAGE

(71) Applicant: ADVANCED VISION TECHNOLOGY (A.V.T.) LTD., Hod Hasharon (IL)

(72) Inventors: Brian Gamm, McKinney, TX (US); Alan Then, Dallas, TX (US); Steven Headley, Arlington, TX (US); Chanan Gazala, Kfar Saba (IL)

(73) Assignee: Advanced Vision Technology (A.V.T.) Ltd., Hod Hasharon (IL)

( * ) Notice: Subject to any disclaimer, the term of this patent is extended or adjusted under 35 U.S.C. 154(b) by 179 days.

(21) Appl. No.: 16/333,183

(22) PCT Filed: Sep. 7, 2017

(86) PCT No.: PCT/IL2017/051006
§ 371 (c)(1),
(2) Date: Mar. 13, 2019

(87) PCT Pub. No.: WO2018/051332
PCT Pub. Date: Mar. 22, 2018

(65) Prior Publication Data

US 2019/0240971 A1 Aug. 8, 2019

Related U.S. Application Data

(60) Provisional application No. 62/393,669, filed on Sep. 13, 2016, provisional application No. 62/554,591, filed on Sep. 6, 2017.

(51) Int. Cl.

| | |
|---|---|
| ***B41F 7/02*** | (2006.01) |
| ***B41F 33/00*** | (2006.01) |
| ***B41F 31/00*** | (2006.01) |

(52) U.S. Cl.
CPC ..... *B41F 7/025* (2013.01); *B41F 31/005* (2013.01); *B41F 33/0036* (2013.01); *B41F 33/0072* (2013.01)

(58) Field of Classification Search
CPC ..... B41F 31/005; B41F 13/30; B41F 31/30; B41F 31/301; B41F 31/304
See application file for complete search history.

(56) References Cited

U.S. PATENT DOCUMENTS

| | | | |
|---|---|---|---|
| 5,122,977 | A | 6/1992 | Pfeiffer |
| 6,041,708 | A | 3/2000 | Kipphan et al. |

(Continued)

FOREIGN PATENT DOCUMENTS

| | | | |
|---|---|---|---|
| DE | 4413735 | A1 | 10/1995 |
| DE | 202006020066 | U1 | 9/2007 |

(Continued)

OTHER PUBLICATIONS

Johanna Johnson, "Aspects of Flexographic Print Quality and Relationship to some Printing Parameters", Karlstad University Studies 2008: 28.

(Continued)

*Primary Examiner* — Matthew G Marini
*Assistant Examiner* — Leo T Hinze
(74) *Attorney, Agent, or Firm* — RatnerPrestia

(57) ABSTRACT

A method controls the color in a printing press, which includes at least one printing station printing a respective color design. The method includes the procedures of determining a control factor to color model, printing a design on a web and acquiring color characteristics corresponding to the printed design on the web. The method further includes the procedures of determining the color quality of the printed color design and determining a required change to at least one control factor when a correction to the color (Continued)

characteristics of the printed design is required. The change to at least one control factor is determined by determining the at least one control factor with respective color related information, which results in a reference color characteristic, according to the control factor to color model. The method returns to the procedure of printing when a correction is not required.

24 Claims, 12 Drawing Sheets

(56) References Cited

U.S. PATENT DOCUMENTS

| | | | | |
|---|---|---|---|---|
| 6,634,297 | B2 | 10/2003 | Poetter et al. | |
| 7,421,948 | B2 * | 9/2008 | Schneider | B41F 31/002 101/349.1 |
| 7,423,778 | B2 | 9/2008 | Hersch et al. | |
| 8,931,410 | B2 | 1/2015 | Noy | |
| 9,393,772 | B2 | 7/2016 | Menashe et al. | |
| 10,262,409 | B2 | 4/2019 | Dekel-Klein et al. | |
| 10,315,412 | B2 | 6/2019 | Menashe et al. | |
| 10,507,667 | B2 | 12/2019 | Gazala et al. | |
| 10,576,751 | B2 | 3/2020 | Gazala | |
| 10,657,640 | B2 | 5/2020 | Dekel-Klein et al. | |
| 10,838,689 | B2 | 11/2020 | Dauth et al. | |
| 2006/0170996 | A1 * | 8/2006 | Headley | B41F 33/0045 358/518 |
| 2014/0268216 | A1 | 9/2014 | Soriano | |
| 2015/0278660 | A1 | 10/2015 | Yamamoto | |
| 2019/0289228 | A1 | 9/2019 | Mazliach et al. | |
| 2020/0154994 | A1 | 5/2020 | Gazala et al. | |

FOREIGN PATENT DOCUMENTS

| | | | |
|---|---|---|---|
| DE | 102007032944 | B4 | 10/2011 |
| DE | 202015101699 | U1 | 7/2016 |
| EP | 0228347 | B2 | 11/1996 |
| EP | 2660056 | A2 | 11/2013 |
| EP | 2886345 | A1 | 6/2015 |
| EP | 2985150 | A1 | 2/2016 |
| IT | RE20120050 | A1 | 1/2014 |
| WO | 2010024944 | A1 | 3/2010 |
| WO | 2012089496 | A1 | 7/2012 |

OTHER PUBLICATIONS

Rastko Milošević et al., "The Effects of Different Printing Pressure Level Application on Sheet-fed Offset Print Quality", International Circular or Graphic Information and Research, No. 7, 2014. Education: 54-65.

Rastko Milošević et al., "Influence of Different Printing Pressure Levels on Sheet-Fed Offset Print Quality", Journal of Chemical Technology and Metallurgy, 49, 4, 2014: 375-382.

International Search Report and Written Opinion for PCT/IL2017/051006, dated Dec. 31, 2017.

Extended European Search Report for European Application No. 17 850 408.0, dated May 26, 2020 10 pages.

* cited by examiner

SYSTEM AND METHOD FOR CONTROLLING COLOR CHARACTERISTICS OF A PRINTED IMAGE

This application is a National Stage application of PCT/IL2017/051006, filed Sep. 7, 2017, which claims priority to U.S. Provisional Patent Application No. 62/393,669, filed Sep. 13, 2016 and U.S. Provisional Patent Application No. 62/554,591, filed Sep. 6, 2017, which applications are incorporated herein by reference. To the extent appropriate, a claim of priority is made to each of the above-disclosed applications.

FIELD OF THE DISCLOSED TECHNIQUE

The disclosed technique relates to controlling color characteristics of a printed image in general, and to methods and system for controlling color characteristics of a printed image by varying the pressure between rollers of a printing station, in particular.

BACKGROUND OF THE DISCLOSED TECHNIQUE

Systems for controlling the color characteristics of a printed image are known in the art. Generally, these systems employ a spectrophotometer to acquire information relating to the color characteristics of a printed image and a processor compares this color information to a reference. When deviations between the measured color and the reference color are detected (e.g., by determining color error in ΔE in a given colors space between the printed image and the reference image), the amount of ink delivered to the substrate is adjusted by controlling ink keys.

U.S. Patent Application Publication 2006/0170996 to Headley et al entitled "Color control of a web printing press utilizing intra-image color measurements" directs to on-line color control for a printing press using intra-image color information. According to the method directed to by Headley et al, for each ink key zone in the image, a predetermined measurement area is located such that an image and spectral reflectance data are captured from that measurement area using a concurrent imaging and spectral reflectance measurement. The captured data from the imaging system is analyzed to ensure the accuracy of the measurement area (i.e., by employing the image data) and in order to determine the spectral reflectance values (i.e., by employing spectral reflectance measurement). The measured spectral reflectance data is then compared to the target reflectance data represented in the same color space, such that the differences therebetween can be determined. In order to determine whether an inking correction is required, the color differences are compared to establish color tolerances for any of the measurement locations of the target in question.

In the on-line color control for a printing press directed to by Headley et al, a spectral reflectance analysis for a given measurement area might calculate the reflectance value for 40 points across the visible spectrum for example, such that each of those 40 points can be compared to the corresponding points in the spectrum for the target image location. Determining whether a correction needs to be made can be performed, for example, by determining if any one, or a selected number of the 40 point differences is out of tolerance. When the corrections need to be made, the ink key corresponding to the measurement area is adjusted accordingly.

SUMMARY OF THE PRESENT DISCLOSED TECHNIQUE

It is an object of the disclosed technique to provide a novel method and system for controlling the color in a printing press. In accordance with the disclosed technique, there is thus provided a method for controlling the color in a printing press. The printing press includes at least one printing station printing a respective color design. The method includes the procedures of determining a control factor to color model, printing a design on a web and acquiring color characteristics corresponding to the printed design on the web. The method further includes the procedures of determining the color quality of the printed color design and determining a required change to at least one control factor when a correction to the color characteristics of the printed design is required. The change to at least one control factor is determined by determining the at least one control factor with respective color related information, which results in a reference color characteristic, according to the control factor to color model. The method returns to the procedure of printing when a correction is not required.

In accordance with another aspect of the disclosed technique, there is thus provided a system for controlling the color in a printing press. The printing press includes at least one printing station printing a respective color design. The system includes a color measurement unit, an actuator interface and a processor, coupled with the color measurement unit and with the actuator interface. The color measurement unit measures the intensity of light reflected from or transmitted through a printed substrate at each of a plurality of spectral ranges over a selected bandwidth. The actuator interface transforms instructions to signals which operate the actuators that move the rollers of the at least one printing station. The processor determines the color quality of the printed color design and also determines a required change to at least one control factor when a correction is required. The change to at least one control factor is determined by determining the at least one control factor with respective color related information, which results in a reference color characteristics, according to a control factor to color model.

BRIEF DESCRIPTION OF THE DRAWINGS

The disclosed technique will be understood and appreciated more fully from the following detailed description taken in conjunction with the drawings in which.

Figure 4:
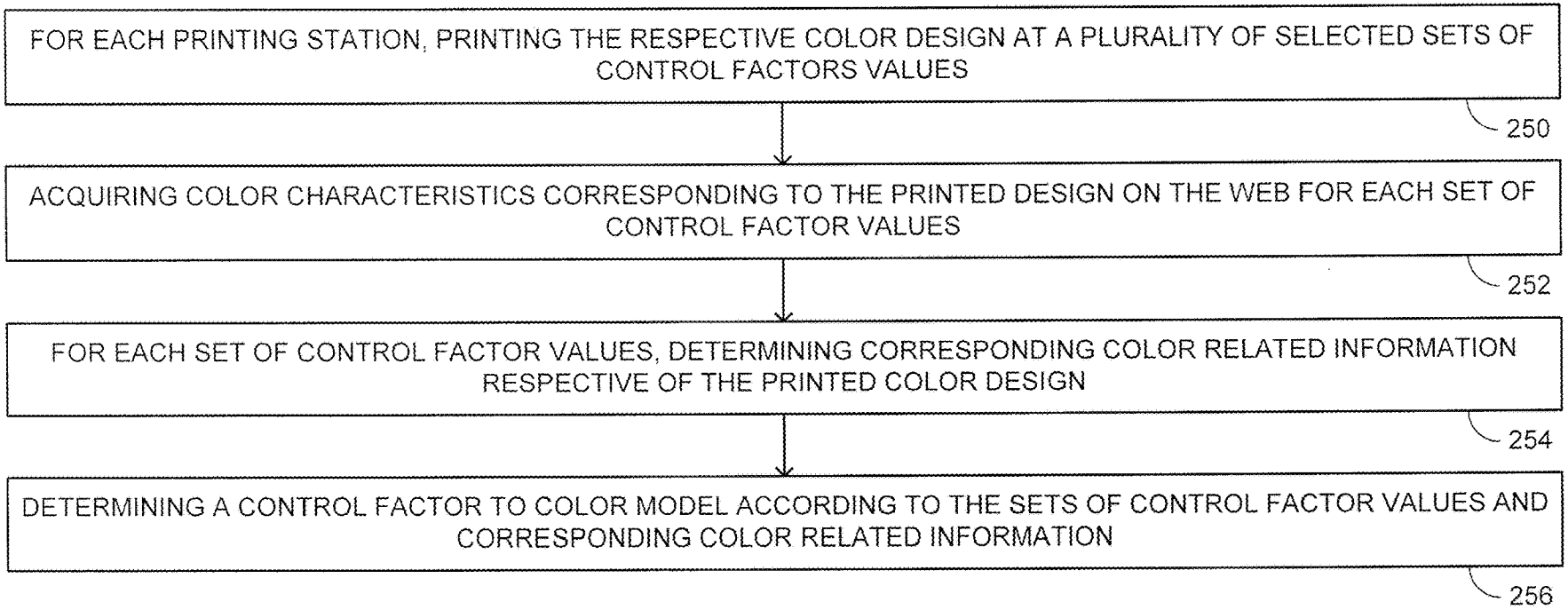
Figure 5A:
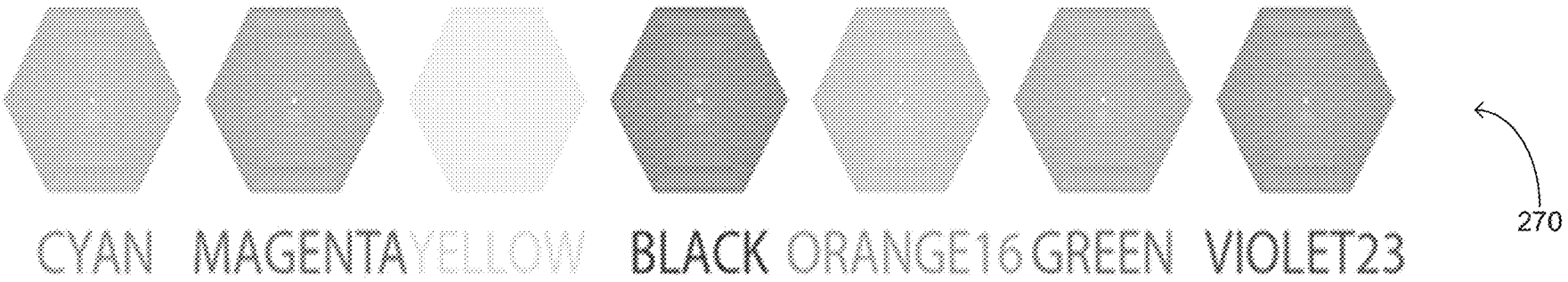
Figure 5B:
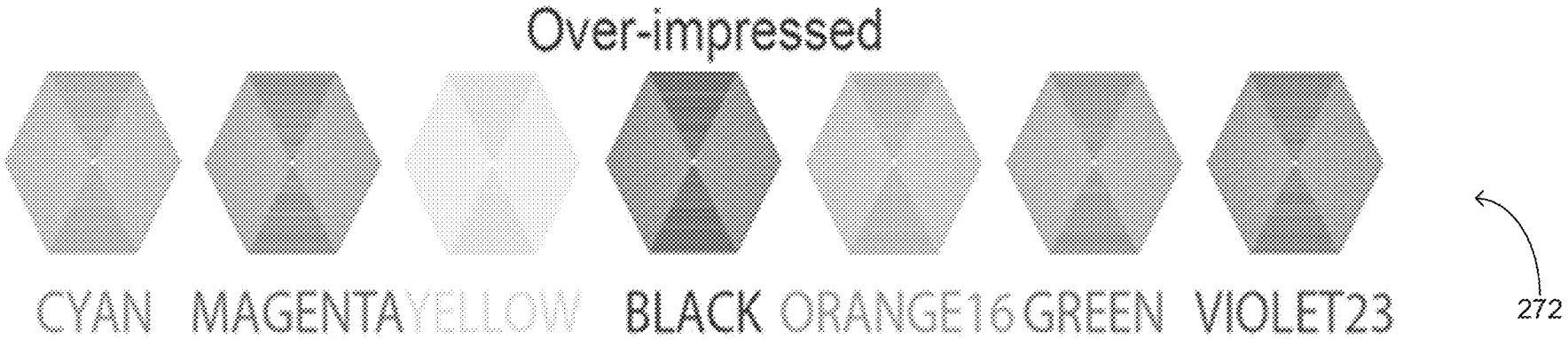
Figure 6:
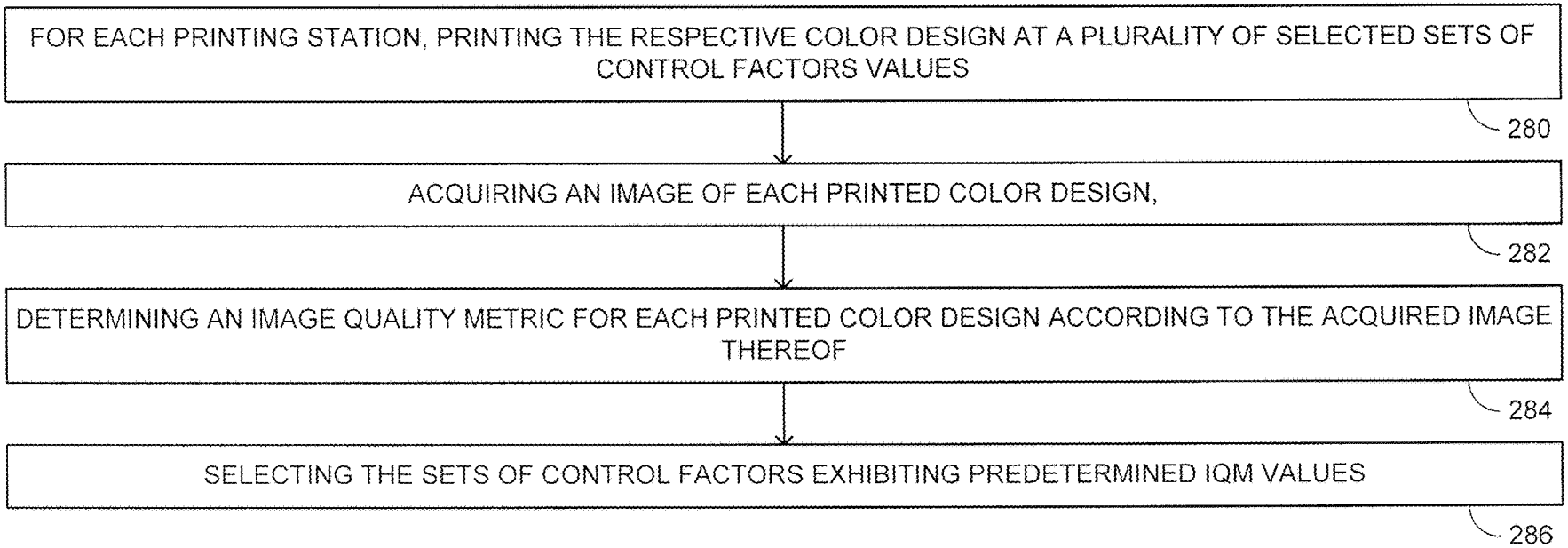
Figure 7A:
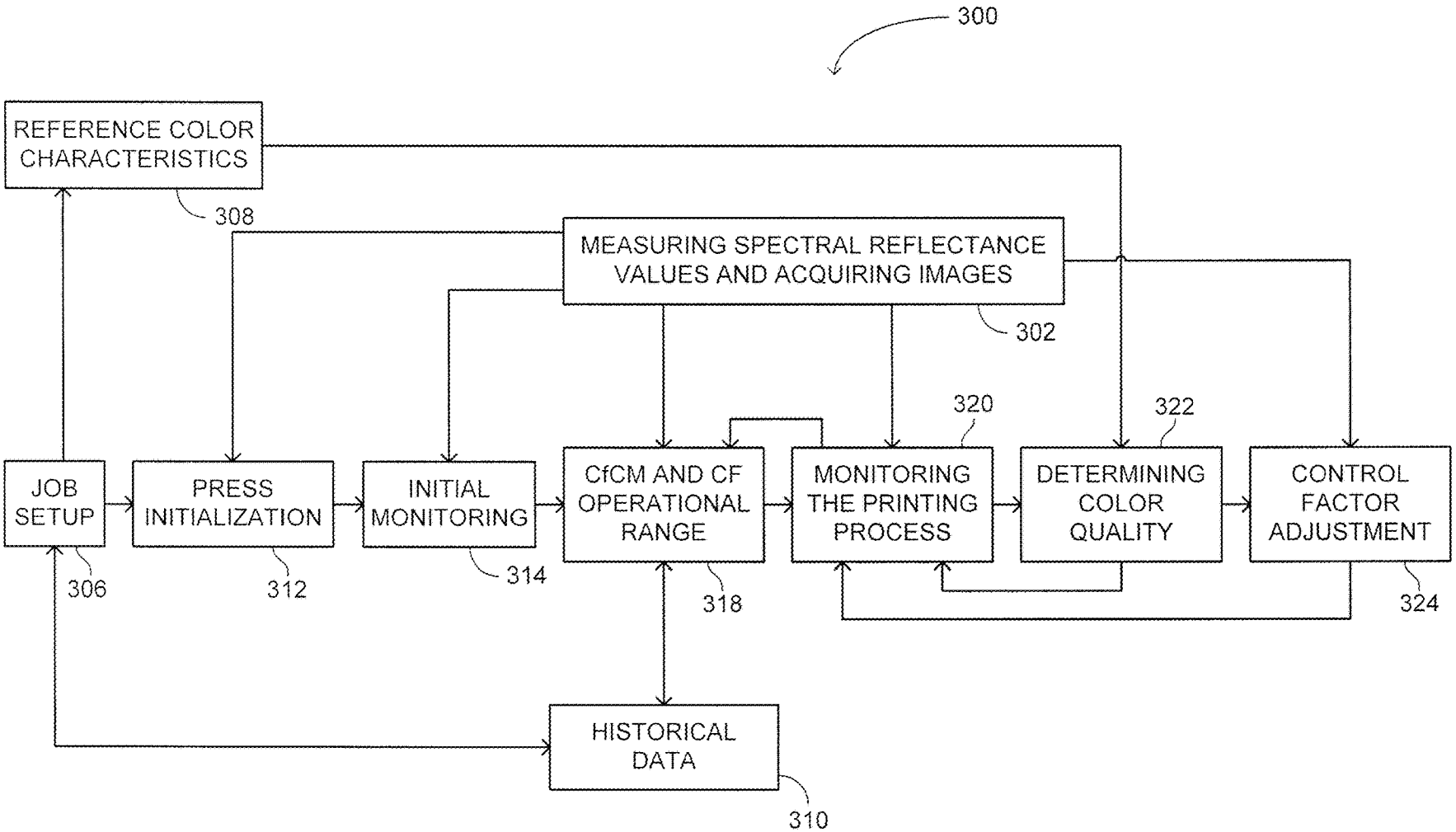
Figure 7B:
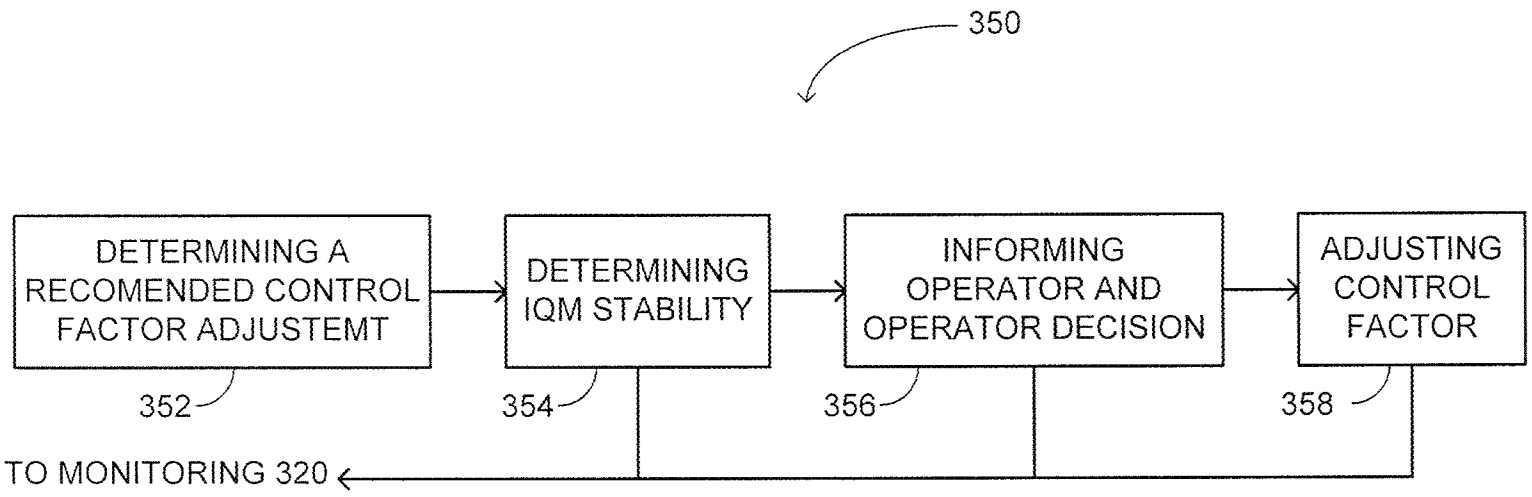
Figure 7C:
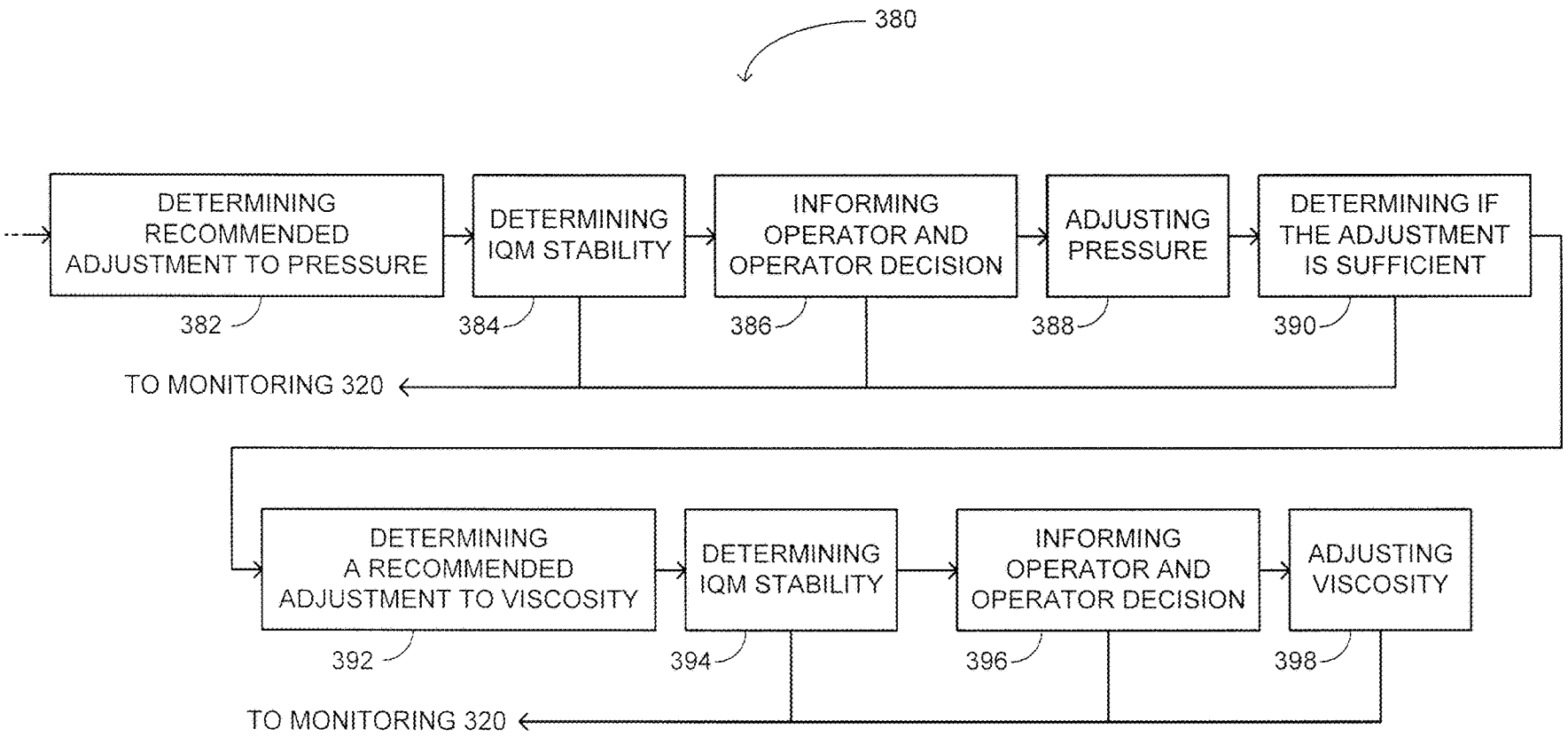

3A-3G are schematic illustrations of an example for determining control factor to color model, in accordance with a further embodiment of the disclosed technique;

FIG. 4 is a schematic illustration of a method for determining a Control factor to Color Model for a printing station, in accordance with another embodiment of the disclosed technique;

FIGS. 5A and 5B are schematic illustration of slur targets which may be employed for determining the color related information of a printed design;

FIG. 6, is a schematic illustration of a method for determining operation pressure range for a printing station, in accordance with a further embodiment of the disclosed technique; and FIGS. 7A, 7B and 7C are schematic illustrations of workflows for controlling color in a printing press, in accordance with another embodiment of the disclosed technique.

DETAILED DESCRIPTION OF THE EMBODIMENTS

The disclosed technique overcomes the disadvantages of the prior art by providing a system and a method for controlling the color characteristics of a design printed on a web by a printing press by varying one or more control factors of the printing station. The printing press includes one or more printing station. Each printing station prints a respective color design on the web. The term 'color design' refers herein to a design being printed on a web by a printing station. The design may be the graphic design itself or of designated target or targets associated with the color being printed by the printing station. The term 'printed composite design' refers herein to the composite design printed on the web resulting from the all color designs printed by each printing station in the printing press.

In general, according to the disclosed technique, the color characteristics of a printed design are controlled by varying one or more control factors of the printing station. In cylindrical printing stations (e.g., flexographic, gravure printing stations and the like), these control factors include the distance between rollers (or associated pressure between the rollers) of the printing station and optionally the viscosity of the ink employed in the printing station. To control the color characteristics of a printed design with such control factors, a Control factor to Color Model (CfCM—further explained below) is determined, which defines the variations in color related information of the printed design as a function of changes in the control factors. Optionally, the operational range of the control factors is determined as further explained below. This control factors operational range is defined as the set of control factor values which may be applied during the print job. Thereafter, the respective color characteristics are acquired for each printed color design. When the acquired color characteristics of the printed color design deviate from reference color related information of the printed design, then, the required change to at least one of the control factors, which results in the reference color characteristics, is determined according to the CfCM. The term 'color characteristics' relates to characteristics of the color of the printed color design such as reflectance values or coordinates in a selected color space (e.g., CIEL*a*b*, CIEL*u*v*, CIEXYZ, RGB, CYMK, HSV, HSL and the like). The term 'color related information' hereinabove and below relates to the color characteristics or to information relating thereto from which color characteristics can be determined, as further explained below.

Figure 1:
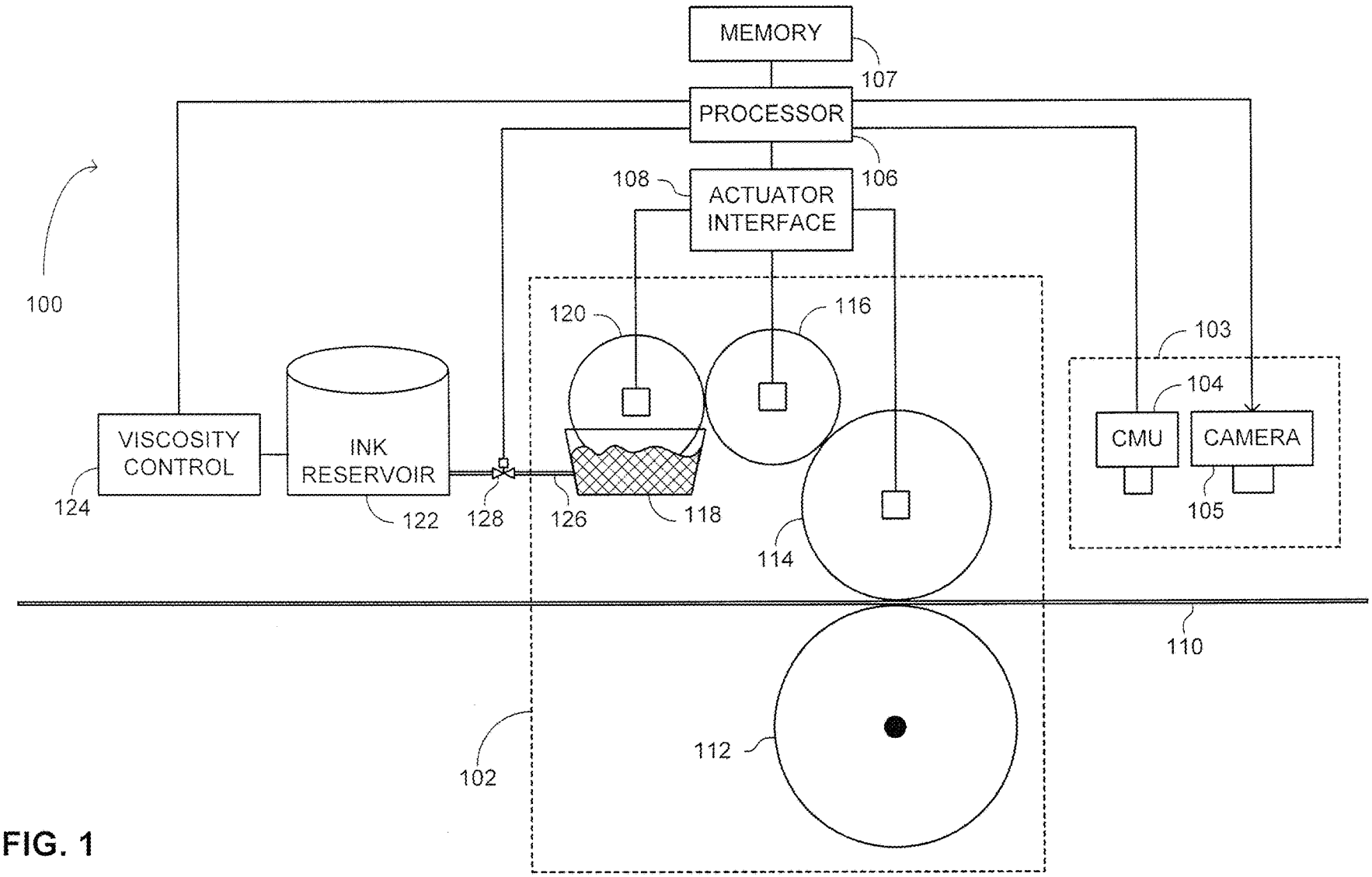
FIG. 1 is a schematic illustration of a system for controlling the color characteristics of a printed image, constructed and operative in accordance with an embodiment of the disclosed technique.

Reference is now made to FIG. 1, which is a schematic illustration of a system, generally referenced 100, for controlling the color characteristics of a printed image, constructed and operative in accordance with an embodiment of the disclosed technique. System 100 varies the distance between the various rollers of a printing station 102 to control the color characteristics of the color design printed by printing station 102 on substrate 110. Furthermore, system 100 may modify the viscosity of the ink to control the color characteristics of the color printed by printing station 102.

System 100 for controlling the color characteristics of a printed color design includes an imaging module 103, a processor 106, a database 107 and an actuators interface 108. Imaging module 103 includes a color measurement unit (CMU) 104, a camera 105. Processor 104 is coupled with CMU 104, with camera 105, with database 107, with actuators interface 108, with valve 128. CMU 104 is, for example, a spectrophotometer which measures the intensity of light reflected from or transmitted through printed substrate 110 at each of a plurality of spectral ranges over a selected bandwidth (e.g., 40 spectral ranges between 360 nanometers and 780 nanometers, each exhibiting a bandwidth of 10 nanometers). Camera 105 is, for example, a color camera (e.g., Red, Green and Blue—RGB camera) acquiring images of the printed image (i.e., which is printed on substrate 110). It is noted that imaging unit 103 may alternatively include a single camera such as an XYZ camera which acquires images in the CIEXYZ color space directly. Actuator interface 108 transforms instructions received from the processor, to signals which operate the actuators that move the rollers of the printing stations in printing press 102.

Prior to describing the system and the functionality thereof, following is a short description of printing station 102, which will aid the description of the disclosed technique. Printing station 102 is depicted in FIG. 1 as a flexographic printing station. However, it is noted that the disclosed technique may also be applicable for other types of printing technologies (e.g., gravure, offset and the like). It is further noted that printing station 102 is brought herein as an exemplary flexographic printing station and there are several variations in the design of such a flexographic printing station (e.g., how ink is delivered from the ink chamber and applied to the anilox roller). However, the disclosed technique applies to all such printing station designs.

Printing station 102 includes an impression roller 112, a plate roller 114, an anilox roller 116 and an ink chamber 118. When printing station 102 prints the respective color design thereof, anilox roller 116 is partially immersed in ink chamber 118. A portion of anilox roller 116, which is not immersed in ink chamber 118, is in contact with printing roller 114. Printing plate is mounted on plate roller 114. Plate roller 114 is further in contact with substrate 110 while impression roller 112 is in contact with the other side of substrate 110 directly opposite from plate roller 114. Optionally, printing station 102 includes a fountain roller 120 between anilox roller 116 and ink chamber 118 (i.e., foundation roller partially immersed in ink chamber 118 and a portion thereof, not immersed in ink chamber 118, is in contact with anilox roller 116). Further involved in the printing process are an ink reservoir 122 and a viscosity controller 124. Ink reservoir 122 is connected to ink chamber 118 via a pipe 126 and a valve 128. Viscosity controller 124 is coupled with ink reservoir 122. Ink reservoir 122 supplies the ink to ink chamber 118. Viscosity controller 124 controls the viscosity of the ink in ink reservoir 122 by adjusting a viscosity control factor. For example, when the ink employed by printing station 102 is an Ultraviolet (UV) based ink, then, viscosity controller 124 controls the viscosity of the ink by increasing or decreasing the temperature of the ink (i.e., temperature is the viscosity control factor). When the ink is a solvent based ink (e.g., water, oil), viscosity controller 124 may include one or more reservoirs, which include a pigment-less solvent (i.e., with a lower viscosity than the ink in ink reservoir 122) or an ink thickener (e.g., ink with a higher viscosity than the ink in reservoir 122). The amount of pigment-less solvent or ink thickener are the viscosity control factors. To increase the viscosity of the ink, ink thickener is added to ink reservoir 122. To decrease the viscosity of the ink, a pigment-less solvent is added to the ink in ink reservoir 122.

In printing station 102, processor 106 may control the distance between the anilox roller 116 and the plate roller 114 (i.e., also referred to herein as 'anilox pressure') and the distance between plate roller 114 and impression roller 112 (i.e., also referred to herein as 'impression pressure') by directing actuator interface 108 to move either anilox roller 116 or plate roller 114. In general, printing station 102 may be a part of a printing press which includes a plurality of such printing stations each printing a respective color design with a respective color at a respective location on the substrate. The overlay of color designs results in a composite printed design on the web.

To control the color characteristics of a printed design with these control factors, a Control Factor to Color Model (CfCM) is determined, which associates the color related information of the printed design with selected sets of control factor values. In the example brought forth in FIG. 1, the control factors are any combination of anilox pressure, impression pressure and viscosity. In order to determine the CfCM, processor 106 directs plate roller 114 and anilox roller 116 to move through selected sets of control factors. At each set of control factors, printing unit 102 prints the respective color design thereof. CMU 104 measures the reflectance values of the color design printed on web 110 (e.g., either of the design itself or of designated printed target or targets associated with the color design) and provides the measured spectral reflectance values to processor 106. Processor 106 determines acquired color related information respective of the printed color design, and thus respective of the set of control factors at which this printed color design was printed. Processor 106 then determines the CfCM according to the sets of control factors and respective color related information as further explained below in conjunction with FIGS. 3A-3G and 4. Thus, the CfCM associates between control factor values and respective color related information for each printing station. It is noted that the selected set of control factors employed for determining the control factors operational range and the CfCM may be a common set (i.e., a single set is employed for determining both control factors operational range and the CfCM) or a different set of selected control factors.

As mentioned above and further elaborated below, optionally, the operational range of the control factors is determined. The control factors operational range is defined as the set control factors which may be applied during the print job. According to one example, the values control factors operational range are the values in which an Image Quality Metric (IQM) of the printed color design exhibits a predetermined set of values. In order to determine the operational pressure range, processor 106, directs actuator interface 108 to move plate roller 114 and anilox roller 116 through the selected sets of distances as well as viscosity controller 124 to change the viscosity of the ink in ink reservoir 122. In other words, processor 106 changes the values of the impression pressure, the anilox pressure and the viscosity of the ink. The terms 'set of control factors' or 'set of control factor values' herein above and below relate to a specific combination of anilox pressure, impression pressure and viscosity value. For each set of control factor values, printing stations prints the respective color design thereof on web 110 and camera 105 acquires an image of the printed color design. For each set of control factor values, processor 106 determines a respective IQM. Thereafter, processor 106 selects the sets of control factors exhibiting predetermined respective IQM values (e.g., the sets of control factors that the respective IQM values thereof are above a predetermined threshold). It is noted that the control factors operational range may also be determined from historical data relating to the job (e.g., from a previous run of the job) stored in memory 107. The control factors operational range may also be updated during the run of the job as further explained below. According to another example, the control factors operational range may be determined from the physical limitations of the printing press. For example, the pressure operational ranges is determined from the set of distances the rollers can move without damaging the printing station and the viscosity operational range is determined according to the set of viscosities the printing press can produce. It is noted that the control factors operational range and the control factors values in the CfCM may be intersected to define the set of control factor values employed for controlling the color of the printed design.

After determining the CfCM and optionally the control factors operational ranges, each printing station prints the respective color design thereof on the web. CMU 104 measures the reflectance values of each color in the printed design and processor 106 determines the color characteristics of each printed color design. These color characteristics are also referred to herein as 'acquired color characteristics'. Processor 106 determines the color quality of each printed color design. Color quality relates to the deviation between the acquired color characteristics and reference color characteristics. When the deviation between the acquired color characteristics and the reference color characteristics exceeds a determined threshold then, a correction to the color characteristics of the printed design is required. According to the CfCM, processor 106 determines the required change to at least one of the control factors (i.e., impression pressure, the anilox pressure or the viscosity or any combination thereof). Processor 106 employs the CfCM to determine the required change to the control factors, by determining the control factors with respective color related information (i.e., as mediated by the CfCM), which results in the reference color characteristics. As mentioned above, the term 'color related information' relates to color characteristics (e.g., reflectance values, coordinates in a color space) or to information related thereto from which color characteristics can be determined. When the control factors operational range is also determined, processor 106 may determine that the required change in the control factors is within the control factors operation range. Processor 106 applies the required change to printing station 102, for example, by directing actuator interface 108 to move either plate roller 114, anilox roller 116 or by directing viscosity controller 124 to modify (i.e., increase or decrease) the viscosity of the ink in ink reservoir 122. After printing the color design with the new control factor values, the printed design may be inspected, (i.e., either automatically or by a user) for various defects such as mis-registration, Moiré patterns, blotches, voids, hickeys, piling, mottling and the like.

Figure 2:
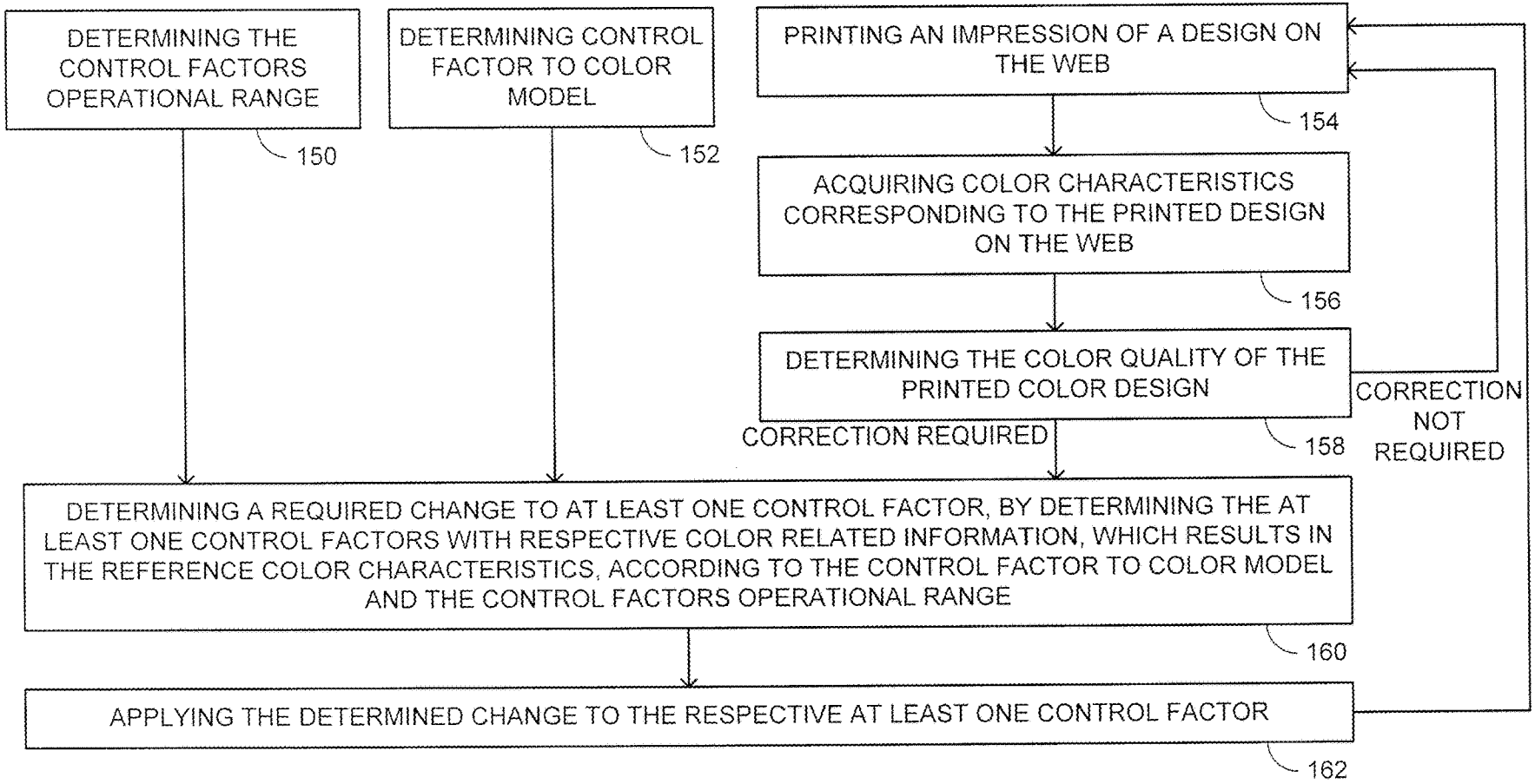
FIG. 2 is a schematic illustration of a method for controlling the color in a printing station in a printing press in accordance with another embodiment of the disclosed technique.

Reference is now made to FIG. 2, which is a schematic illustration of a method for controlling the color in a printing station in a printing press in accordance with another embodiment of the disclosed technique.

In procedure 150 a CfCM (i.e., Control factor to Color Model) is determined. The CfCM defines the variations in color related information, of the printed design as a function of changes in control factors (i.e., anilox pressure, impression pressure and viscosity). The CfCM is determined by directing the plate roller and the anilox roller to move through the selected sets of distances as well as modifying the viscosity of the ink, printing a color design on the web and determining the color related information of the printed color design. Thus, each set of control factors is associated with respective color related information. With reference to FIG. 1, processor 106 directs plate roller 114 and anilox roller to move through selected sets of distances between the anilox and plate rollers and between plate and impression rollers. CMU 104 measures the reflectance values of the color design printed on web 110 and processor 106 determines color related information respective of the printed color design and thus respective of the set of distance at which this printed color image was printed. After procedure 150, the method proceeds to procedure 160.

In procedure 152, the control factors operational range is determined. The control factors operational range is defined as the set of control factors at which an IQM of a printed design respective of a printing station exhibits a predetermined set of values. The control factors operational ranges is defined by determining the IQM associated with each of a plurality of prints of the color design respective of the printing station, at a plurality of sets of control factors. The control factors operational range may also be determined from historical data relating to the job (e.g., from a previous run of the job). The control factors operational range may also be updated during the run of the job as further explained below. According to another example, the control factors operational range may be determined from the physical limitations of the printing press. For example, the pressure operational ranges is determined from the set of distances the rollers can move without damaging the printing station and the viscosity operational range is determined according to the set of viscosities the printing press can produce. It is noted that procedure 152 is optional. With reference to FIG. 1, processor 106 directs plate roller 114, anilox roller 116 and valve 128 to move through selected sets of control factors values while printing station 102 prints the respective color design thereof at each set of values. Camera 105 acquires an image of the printed design at each set of values. Processor 106 determines the IQM associated with each printed color design according to the respective acquired image. Accordingly, processor 106 determines the sets of control factors exhibiting predetermined respective IQM values. After procedure 152, the method proceeds to procedure 160.

In procedure 154 a color design is printed on a web. With reference to FIG. 1, printing press 102 prints a design on web 110.

In procedure 156, color characteristics, respective of the printed color design area acquired. These acquired color characteristics may be the spectral reflectance values. The acquired color characteristics may also be color coordinates in a color space (e.g., CIEL*a*b*, CIEL*u*v*, CIEL*C*H*, CIEXYZ, RGB, CYMK and the like). With reference to FIG. 1, CMU 104 measures spectral reflectance values of the printed design on web 110 and provides the measured spectral reflectance values to processor 106. Processor 106 determines the color related information respective of the printed design on web 110.

In procedure 158 the color quality of the printed design is determined. Color quality relates to the deviation between the acquired color characteristics and reference color characteristics. For example, when the color characteristics are the coordinates of the color in a color space such as CIEL*a*b* color space, the color quality metric used is, for example, the ΔE00 or the ΔEcmc between the acquired CIEL*a*b* target CIEL*a*b*. When the color characteristics are the spectral reflectance values, then the color quality metric used may be the spectral distance between the acquired spectral reflectance values and reference spectral reflectance values (e.g., determined according to the Root Mean Square Error—RMSE). When deviation between the acquired color characteristics and the reference color characteristics exceeds a determined threshold then a correction to the color characteristics of the printed design is required. With reference to FIG. 1, processor 106 determines color quality of the printed design. When a correction to the color characteristics of the printed design is required, the method proceeds to procedure 160. When no correction to the color characteristics of the printed design is required, the method returns to procedure 154.

In procedure 160 a required change to at least one control factor is determined, by determining the control factors with respective color related information, which results in the reference color characteristics. The control factors with respective color related information which results in the reference color characteristics are determined from the CfCM and optionally according to the control factors operational range. The control factor may be one or more pressure between the rollers of the printing station and viscosity, or any combination thereof. As mentioned above, the set of control factor values employed for controlling the color the printed design may be defined from the intersection of the control factors operational range and the control factors values in the CfCM. With reference to FIG. 1, processor 106 determines the required change to at least one control factor.

In procedure 162, the determined change to the respective control factor is applied. For example, the distance between the plate and impression rollers is adjusted to correct the color deviation or the viscosity of the ink is modified. With reference to FIG. 1, processor 106 applies the determined change to the respective control factor.

Determining Control Factor to Color Model

As mentioned above the Control factor to Color Model (CfCM) associates between control factor values and respective color related information. In other words, the CfCM is a function between a set of selected control factors and color related information. As mentioned above, these control factors are the distance between rollers and optionally the viscosity of the ink. In order to determine the CfCM of a printing station, the printing station prints the respective color design thereof for each of the selected sets of the control factors. For each printed color design, the color related information thereof is determined. Thereafter, the color to pressure model is determined according to the sets of control factors and the determined respective color related information. This model may be in the form of a look-up table (LUT) or in the form of a mathematical model. For example, as further elaborated below in conjunction with FIGS. 3A-3G, the sets of control factor values and the color related information define points in a control factors to color space. These points may be fitted to a selected function (e.g. a multivariate polynomial of a selected degree).

Figure 3A:
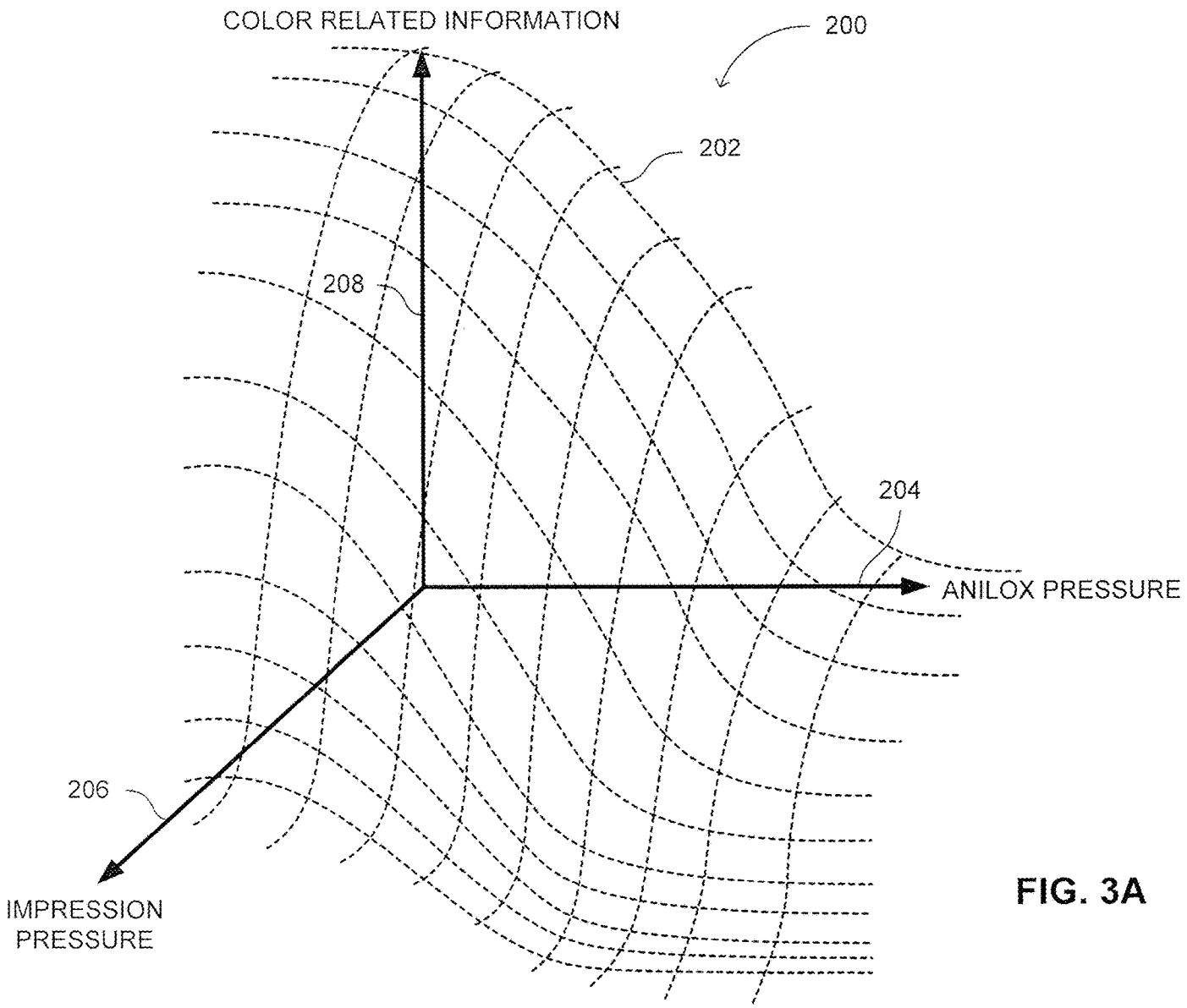

Following is an example of determining the CfCM. For simplicity of the example, only anilox pressure and impression pressure are brought forth as examples of control factors. Reference is now made to FIGS. 3A-3G, which are schematic illustrations of an example for determining control factor to color model, in accordance with a further embodiment of the disclosed technique. In general, the control factor value and the color related information define a control factors to color space 200. FIG. 3A depicts control factors to color space 200 which is defined by different anilox pressures (axis 204) values, impression pressures (axis 206) values and respective color related information (axis 208). A CfCM 202, which maps the sets of control factors to respective color related information, is defined in space 200. In the example brought forth in FIGS. 3B-3G, the CfCM is a second order function relating anilox pressure and impression to the control factors and the IQM as follows:

$$\hat{y} = \hat{\beta}_o + x'b + x'Bx \tag{5}$$

where $$x = \begin{bmatrix} AP \\ IP \end{bmatrix}, b = \begin{bmatrix} \hat{\beta}_1 \\ \hat{\beta}_2 \end{bmatrix}, B = \begin{bmatrix} \hat{\beta}_{11} & \hat{\beta}_{12}/2 \\ \hat{\beta}_{21}/2 & \hat{\beta}_{22} \end{bmatrix}, \hat{y} \in [s_1, s_2, s_3, IQM]$$

and where AP is anilox pressure, IP is impression pressure, and $\hat{\beta}_1$, $\hat{\beta}_2$, $\hat{\beta}_{11}$, $\hat{\beta}_{12}$, $\hat{\beta}_{21}$, $\hat{\beta}_{22}$ are the regression coefficients for the second order model, $s_1$, $s_2$ and $s_2$ are color related coefficients as further explained below.

Figure 3C:
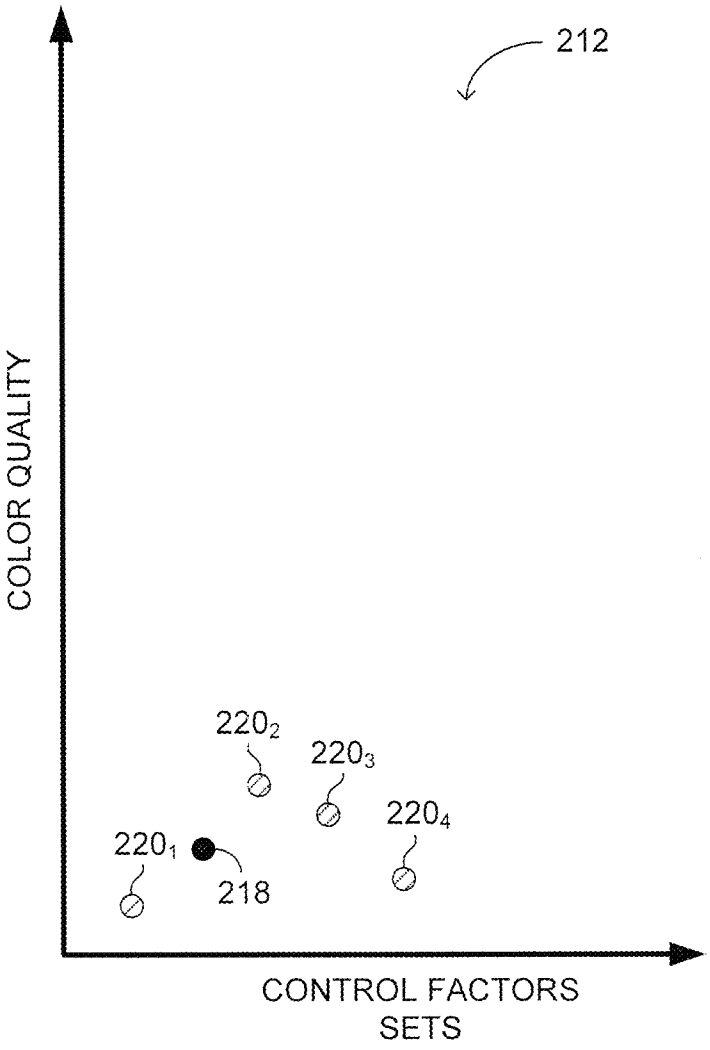
Figure 3B:
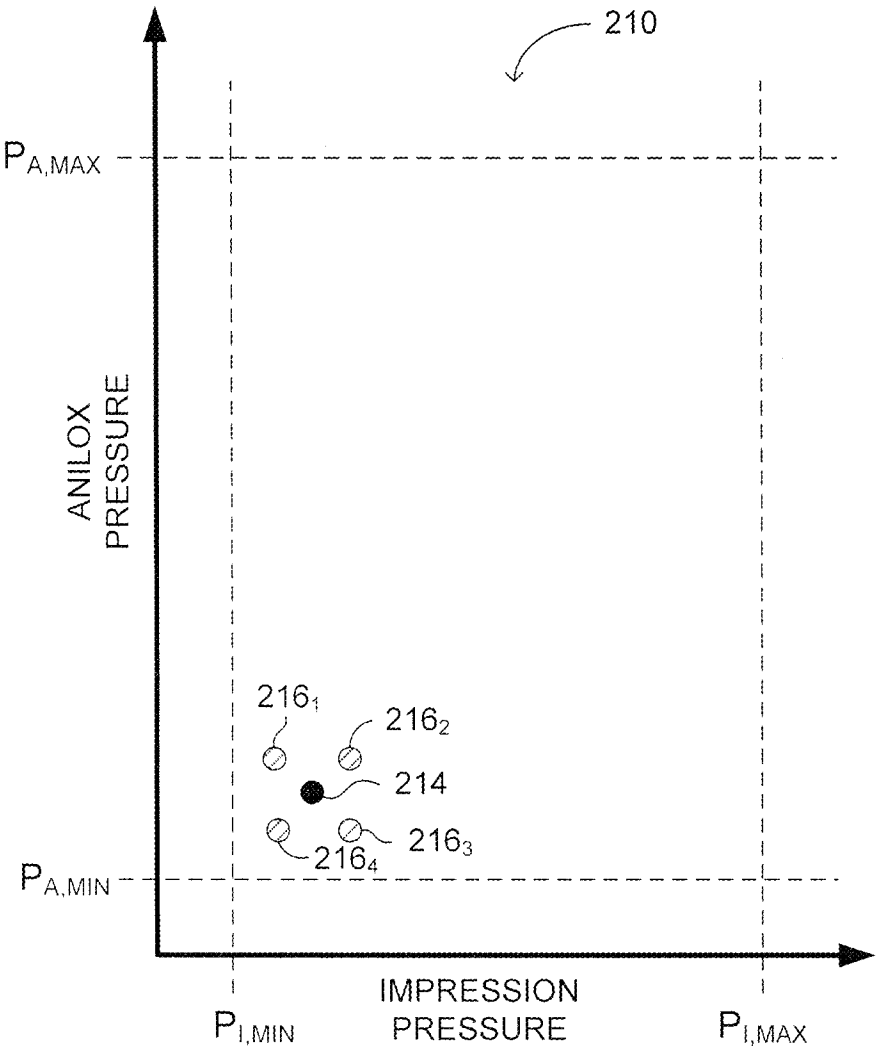
Figure 3E:
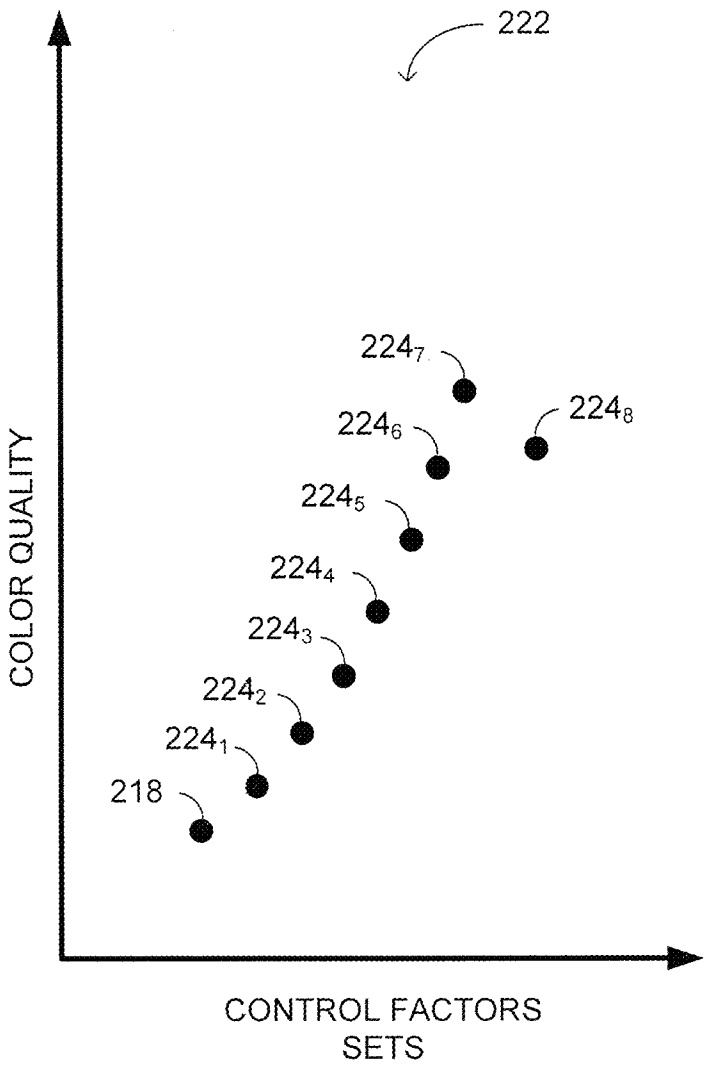
Figure 3D:
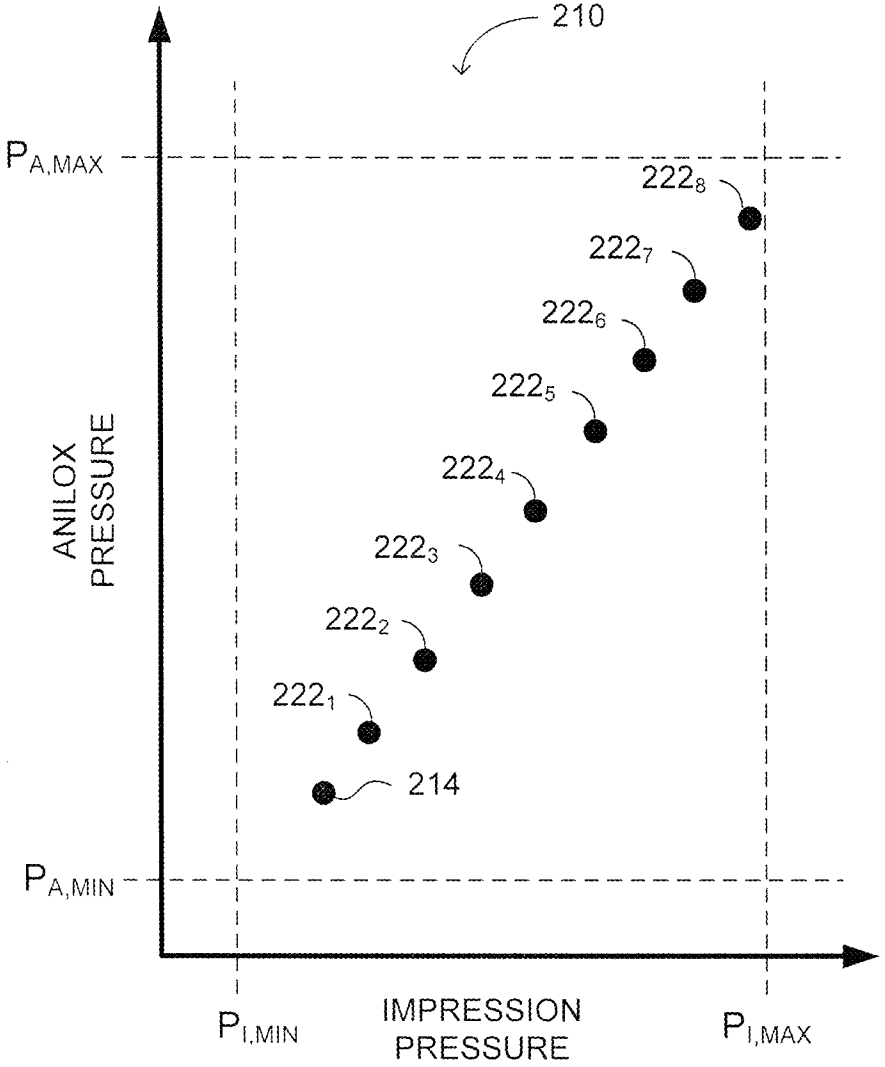
Figure 3G:
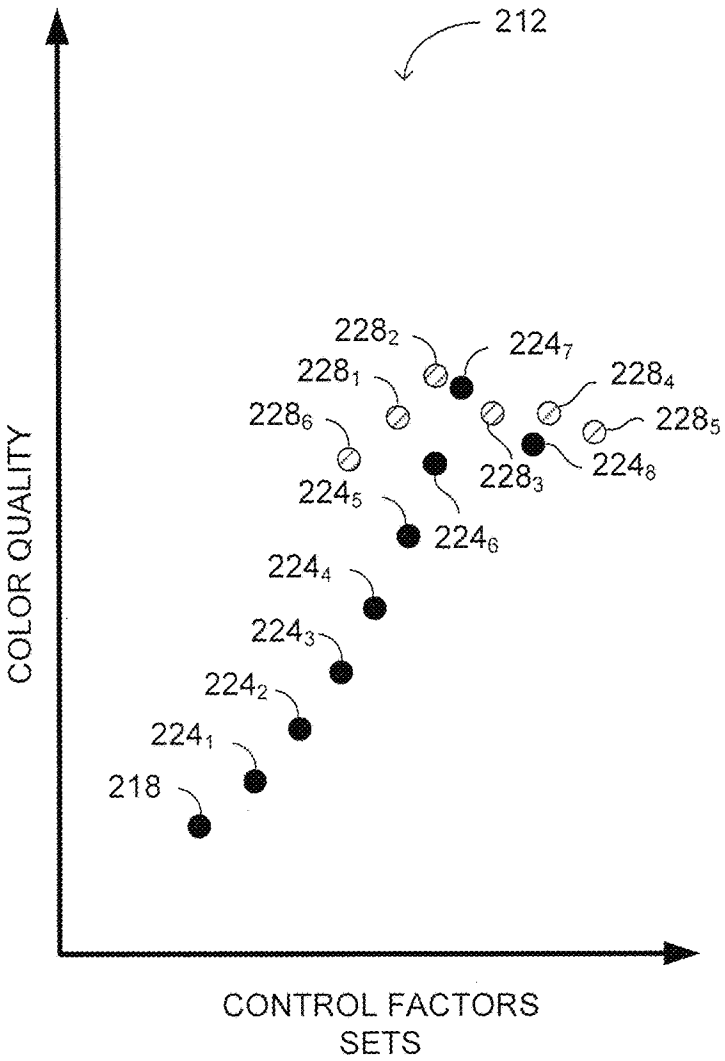
Figure 3F:
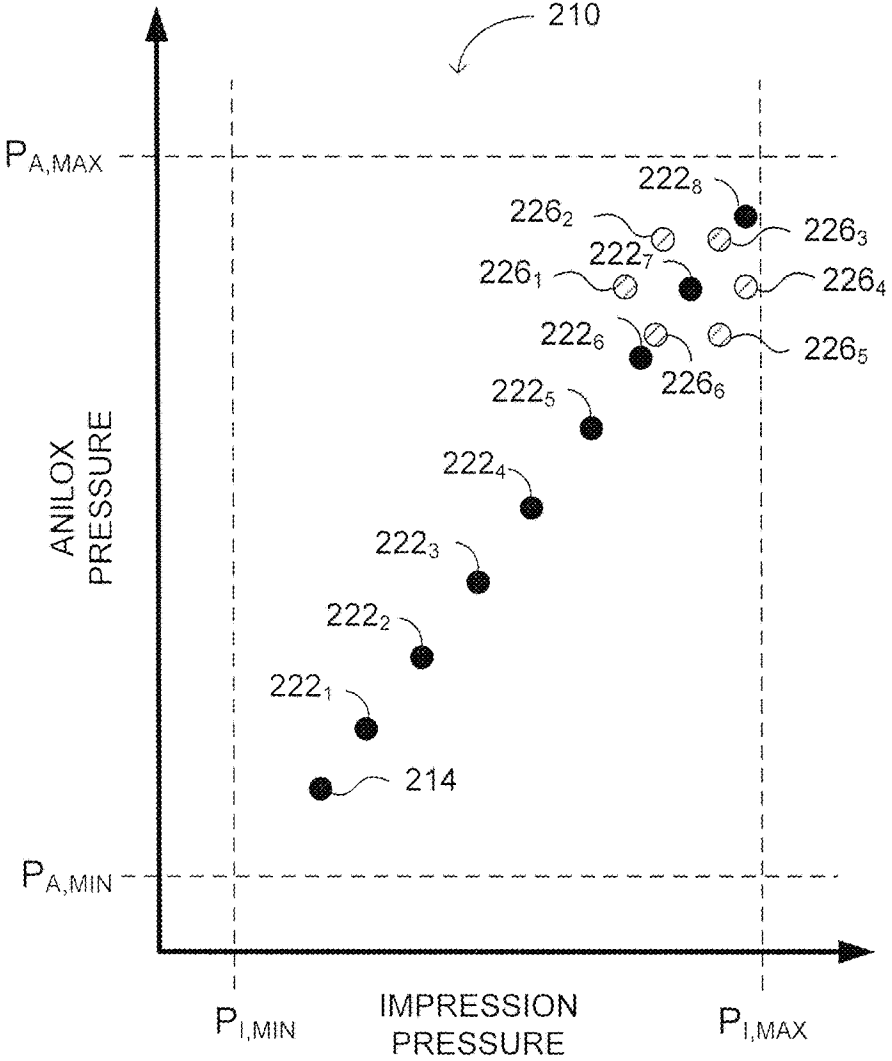

FIGS. 3B-3G depict an exemplary selection of sets of control factors according to the steepest ascent criterion. In FIGS. 3B, 3D and 3F, each set of control factors is depicted as point on graph 210. Furthermore, in FIGS. 3C, 3E and 3G, the mappings between the sets of control factors to the respective color quality thereof are depicted as points on graph 212.

Initially, with reference to FIGS. 3B and 3C, the anilox pressure and the impression pressure (i.e., the set of control factors) are set to the optimal pressure point 214 (determined during the printing press initialization) and the color quality at optimal pressure point 214 is determined (i.e., depicted as point 218 in FIG. 3C). Thereafter, the color related information and the color quality at various sets of control factors, surrounding optimal pressure point 214, which exhibits anilox and impression pressures above and below optimal pressure point 214, is also determined. This various sets of control factors are depicted as points $\mathbf{216}_1$, $\mathbf{216}_2$, $\mathbf{216}_3$ and $\mathbf{216}_4$ in FIG. 3B. The mapping of the color quality respective of points $\mathbf{216}_1$, $\mathbf{216}_2$, $\mathbf{216}_3$ and $\mathbf{216}_4$ are depicted as points $\mathbf{220}_1$, $\mathbf{220}_2$, $\mathbf{220}_3$ and $\mathbf{220}_4$ in graph FIG. 3C. Points $\mathbf{216}_1$, $\mathbf{216}_2$, $\mathbf{216}_3$ and $\mathbf{216}_4$ define a planar surface in space 200. The slope and direction of this surface, toward maximum color quality is determined.

Thereafter, with reference to FIGS. 3D and 3E, the control factors are set to values represented by points $\mathbf{222}_1$-$\mathbf{222}_8$ until the color quality decreases. Points $\mathbf{222}_1$-$\mathbf{222}_8$ are substantially located in the direction of increasing color quality toward maximum color quality (i.e., within resolution of the printing station), according to the above mentioned slope and direction of the planar surface toward maximum color quality. Points $\mathbf{224}_1$-$\mathbf{224}_8$ represent the mapping between the sets of control factors $\mathbf{222}_1$-$\mathbf{222}_8$ to the respective color qualities thereof. At point $\mathbf{224}_8$ the color quality was reduced relative to point $\mathbf{224}_7$.

Also, with reference to FIGS. 3F and 3G, the color quality at various sets of control factors, surrounding point $\mathbf{222}_7$, which exhibits anilox and impression pressures above and below optimal pressure point $\mathbf{222}_7$, are also determined. This various sets of control factors are depicted as points $\mathbf{226}_1$, $\mathbf{226}_2$, $\mathbf{226}_3$, $\mathbf{226}_4$, $\mathbf{226}_5$ and $\mathbf{226}_6$ in FIG. 3F. The mapping of the color quality respective of points $\mathbf{226}_1$, $\mathbf{226}_2$, $\mathbf{226}_3$, $\mathbf{226}_4$, $\mathbf{226}_5$ and $\mathbf{226}_6$ are depicted as points $\mathbf{228}_1$, $\mathbf{228}_2$, $\mathbf{228}_3$, $\mathbf{228}_4$, $\mathbf{228}_5$ and $\mathbf{228}_6$ in FIG. 3G. Employing the points $\mathbf{222}_7$, $\mathbf{226}_1$-$\mathbf{226}_6$, a model, such as model 202 (FIG. 3A) is determined. It is noted that additional mapping points between sets of control factors to respective color quality may be employed when such mapping points are available (e.g., points $\mathbf{216}_1$-$\mathbf{216}_4$ and point 214).

FIGS. 3B-3G depict an exemplary method for determining the CfCM in which the control factor points employed for determining the CfCM are selected according to the principal or steepest ascent. As a further example, the points of the control factors employed for determining the CfCM may also be randomly selected or uniformly selected (i.e., the points are uniformly distributed over the control factors space). It is also noted, for the sake of clarity, color related information is depicted as a single dimension (i.e., axis 208) in control factors to color space 200. However, since color related information relates to the color characteristics or to information relating thereto, color related information relates to a plurality of dimension.

As mentioned above, the term color characteristics relates, for example, to either reflectance values or coordinates in a selected color space and the term color related information relates to color characteristics or to information relating thereto from which color characteristics can be determined. When, for example and referring back to FIG. 1, the color related information employed in the CfCM is reflectance values acquired by CMU 104 (e.g., a spectrophotometer). In such a case, CMU 104 may produce, for example, 40 values. When a correction in the color of the printed design is required, a required change to at least one control factor, which results in the reference color characteristics, is determined according to the CfCM. In other words, processor 106 searches in control factors to color space 200 (FIG. 3A), for the reflectance values with the respective control factors, which results in the reference color characteristics (which may be provided in coordinates in a color space). When the color related information is the reflectance values acquired by a spectrophotometer, such a search is conducted over 40 dimensions.

To reduce the number of dimensions, over which such a search is conducted, Principal Component Analysis (PCA) may be employed. Accordingly, when the CfCM is determined, reflectance values are measured for each set of control factors. Thus, a plurality of reflectance values measurements are determined (e.g., 40 measurements when a spectrophotometer is employed), each measurement defining a point in a 40 dimension space. Thereafter, these measurements are employed in a PCA, which transforms these measurements into to a representation in a space with a selected number of dimensions less than 40 (e.g., 3), where each dimension is represented by a respective basis vector. The spectral reflectance values may be reconstructed from these basis vectors according to weights associated with each basis vector. Accordingly, the CfCM maps the sets of control factors to respective basis vector weights (i.e., coefficients s1, s2 and s3 in Equation 5 above). Thus, when the basis vectors are employed, processor 106 searches for the basis vector weights, with the respective set of control factors, which results in the reference color characteristics. Accordingly, when the number of basis vectors is, for example 3, the search space is reduced from 40 dimensions to 3 dimensions. As such, the term color related information relates, for example, to reflectance values, coordinates in a color space or weights of PCA basis vectors, which are related to the color characteristics (e.g., reconstructed reflectance values, may be determined form the basis vector weights and coordinates in a color space may be determined from the reconstructed reflectance values).

Reference is now made to FIG. 4, which is a schematic illustration of a method for determining a Control factor to Color Model for a printing station, in accordance with another embodiment of the disclosed technique. In procedure 250 for each printing station, the respective color design is printed at a plurality of selected sets of control factors values. With reference to FIG. 1, printing station 102 prints the respective color design thereof on web 110 at a plurality of selected sets of control factors.

In procedure 252, color characteristics, respective of the printed color design are acquired for each set of control factor values. These acquired color characteristics may be the spectral reflectance values. The acquired color characteristics may also be color coordinates in a color space. With reference to FIG. 1, CMU 104 measures spectral reflectance values of the printed design on web 100 and provides the measured spectral reflectance values to processor 106. Processor 106 determines the color related information respective of the printed design on the web.

In procedure 254, for each set of control factors values, corresponding color related information, respective of the printed color design, is determined. The color related information may be reflectance values, coordinates in a color space or information related thereto such as weights of basis vectors resulting from PCA of the acquired reflectance values. With reference to FIG. 1, CMU 104 measures spectral reflectance values of the printed design on web 100 and provides the measured spectral reflectance values to processor 106. Processor 106 determines the color related information respective of the printed design on the web.

In procedure 256, a Control factors to Color Model (CfCM) is determined according to the sets of control factors and respective color related information. The sets of control factors values and corresponding color related information define points in a control factors to color space. The CfCM may be in the form of an LUT or in the form of a mathematical model such as a selected function. With reference to FIG. 1, processor 106 determines the CfCM.

Determining Control Factors Operational Range

As mentioned above, when determining the control factors operational range, processor 106 directs actuator interface 108 to move plate roller 114 and anilox roller 116 through the selected sets of distances, as well as viscosity controller 124 to modify the viscosity of the ink in ink reservoir 122 as mentioned above. Following is one example of moving plate roller 114 and anilox roller 116 through the selected sets of distances. Initially, processor 106 directs actuator interface 108 to move plate roller 114 to move such that distance between plate roller 114 and impression roller 112 ensures the full print of the printed color design on web 110 (e.g., determined according to the thickness of the plate and web 110). Furthermore, processor 106 directs actuator interface to move anilox roller 116 such that it is completely detached from plate roller 204. Thereafter, processor 106 directs actuator interface 108 to decrementally move anilox roller 116 toward plate roller 112, while camera 105 acquires images of the printed area on web 110 with each unit decrement in distance. As anilox roller 116 moves toward plate roller 114 and comes into contact therewith, plate roller 114 receives ink from anilox roller 116 and prints the color design respective of printing station 102 onto the printed area of web 110. When the distance between anilox roller 116 is not in full contact with plate roller 114, the printed image may be incomplete (i.e., partial printed image due to partial ink transfer). Processor 106 directs anilox roller 202 to move until the distance between anilox roller 116 and plate roller 114 is minimal (i.e., the minimum distance between the rollers that does not damage the printing press or the rollers).

After anilox roller 116 is adjacently attached to plate roller 114, processor 106 directs both anilox roller 116 and plate roller 114, to move in unison away from impression roller 112. As anilox roller 116 and plate roller 114 move away from web 110, the printed image becomes partial due to insufficient ink transfer from anilox roller 116 and plate roller 114. When plate roller 114 is fully detached from (i.e., loses all contact with) web 110, printing station 102 stops printing the printed image on web 110. For each increment of a unit distance between plate roller 114 and impression roller 114, camera 105 acquires an image of the printed area of web 110. Thus, a plurality of images of the printed color design are acquired, where each image associated with a respective set of distances between the rollers.

After acquiring the images during the displacement of anilox roller 116 toward plate roller 114 and the displacement of both anilox roller 116 and plate roller 114 away from web 110, processor 106 determines an IQM for each acquired image and thus for each printed color design. IQM is further explained below. After determining an IQM for each printed color design, processor 106 determines the set of distances between plate roller 114 and impression roller 112 and between plate roller 116 and anilox roller which yielded printed color designs with respective IQMs, which exhibit one of a predetermined set of values (e.g., the distance in which the IQMs of the printed color designs are above a predetermined value). Thus, the operational range of the distance is determined. Similarly, in order to determine the operational range of viscosity, processor 106 directs viscosity controller 124 to incrementally modifying the viscosity of the ink in ink reservoir 122. Printing station 102 prints the respective color design thereof and camera 105 acquires an image of the printed color design with each incremental change in the viscosity. Processor 106 determines an IQM for each image and thus for each printed color design. After determining an IQM for each printed color design, processor 106 determines the set of viscosity values which yielded printed color designs with respective IQMs which exhibit one of a predetermined set of values. Thus, the operation range of the control factors is determined. A deviation from the control factors operational range may result in a degradation of the image quality.

In general, the image visible parameters may be independent of the acquired color characteristics of the printed design. In other words, although the acquired color characteristics may be within a determined tolerance (i.e., a determined ΔE's), the quality of the printed design may be poor due to defects (e.g. the above mentioned miss-registration, Moiré patterns, blotches, voids, hickeys, piling, mottling). As such, an IQM according to the disclosed technique relates to the visible quality of the printed design. According to the disclosed technique, the IQM may be one of several options. For example, the IQM may be the Subjective Quality Factor (SQF), Square-root Integral (SQRI) or Acutance, which are derived from the Modulation Transfer Function (MTF) which are a measure of the sharpness of the image Another example of the IQM is the Weighted Normailized Cross Correlation (WNCC) metric given by:

$$WNCC(X, Y, W) = \frac{cov_W(X, Y, W)}{\sqrt{cov_W(Y, Y, W) * cov_W(Y, Y, W)}} \quad (1)$$

where X is the acquired image of the printed design, Y is a reference image, W are the image pixel weighting factors (i.e., each pixel is associated with a respective weight) and $cov_W$ is the weighted correlation function. The weights employed in the WNCC are derived from the Structural Similarity Index (SSIM). The SSIM is determined for each pixel in the image by employing a window around the pixel and around the corresponding pixel in a reference image and determining the following:

$$SSIM(X, Y) = \frac{(2\mu_x\mu_y + c_1)(2\sigma_{xy} + c_2)}{(\mu_x^2 + \mu_y^2 + c_1)(\sigma_x^2 + \sigma_y^2 + c_2)} \quad (2)$$

Where Y is the first image, Y is the second image, $\mu_x$ is the average of the first window $\mu_y$ is the average of the second window $\sigma_x^2$ is the variance of the first window, $\sigma_y^2$ is the variance of the second window and $\sigma_{xy}$ is the covariance between the first window and the second window. Furthermore, $c_1=(K_1L)^2$, $c_2=(K_2L)^2$ are variables which stabilize the division with a small denominator where, L is the dynamic range of the pixel-values (typically $2^{\#\ bits\ per\ pixel}-1$), $K_1=0.01$ and $K_2=0.03$ by default.

The matrix of SSIM values for an image is called the SSIM map, because it maps image differences across the image space. An Enhanced SSIM map (ESSIM), is determined according to the following:

$$ESSIM(X,Y)_{map}=round(max(0.25,1-SSIM(X,Y)_{map}) *255) \quad (3)$$

The inverse of the SSIM, $1-SSIM(X, Y)_{map}$ is employed for determining the ESSIM because the best possible similarity should be 0 rather than 1 (as in the SSIM). The ESSIM will have a value of 64 (pixel value) for $SSIM(X, Y)_{map}>0.75$ and a value between 64 and 255 otherwise. The ESSIM is used as the weighting matrix, W, in Equation 1. Greater weight will be given to areas of the image that are dissimilar in the calculation of the WNCC. The final IQM is the maximum value of the WNCC matrix determine in Equation (1) as follows:

$$IQM=max(WNCC(X,Y,W)) \quad (4)$$

An IQM value of 1.0 means the two images, X and Y, are perfectly similar and a value of 0.0 means two images are perfectly dissimilar. The reference image employed for determining the IQM is either a master created during job setup or digital representation of the design to be printed, such as a PDF or TIFF generated from the PDF by a Raster Image Processor (RIP).

In general, the IQM may be determined for either an image of the printed design, an image of selected parts of the printed design, an image of printed targets, or a combination thereof. For example, when an image or images of both printed targets and selected parts of the printed design are employed, an IQM may be determined for the targets employing one type of IQM (e.g., SQF), and for the selected parts of the printed design employing another type of IQM (e.g., the above mentioned WNCC). The IQM of the printed design may be a weighted combination or the IQM associated with the selected parts of the printed design and the IQM associated with the targets.

When employing targets, the targets may be, for example, slur targets outlined in the FIRST 4.0 specifications, Section 20.4.8. Reference is now made to FIGS. 5A and 5B which are schematic illustration of slur targets which may be employed for determining the color related information of a printed design. FIG. 5A depicts a set 270 of slur targets of the colors cyan magenta yellow black orange 16 green and violet 23, which are printed with the optimal pressure settings. FIG. 5B depicts a set 272 of slur targets of the same colors which exhibit "hour-glass" pattern when over-impressed condition exists. The individual slur targets may be employed as separate elements in the printed design or incorporated directly into the color bar. The slur targets will be analyzed individually for each printing station.

Reference is now made to FIG. 6, which is a schematic illustration of a method for determining control factors operational range for a printing station, in accordance with a further embodiment of the disclosed technique. In procedure 280, for each printing station, the respective color design is printed at a plurality of selected sets of control factors values. With reference to FIG. 1, printing station 102 prints the respective color design thereof on web 110 at a plurality of selected sets of control factors values.

In procedure 282, an image of each printed color design is acquired. With reference to FIG. 1, camera 105 acquires an image of each printed color design.

In procedure 284, an Image Quality Metric (IQM) is determined for each printed color design according to the acquired image thereof. Thus, a respective IQM is associated with each set of control factors. The IQM may be, for example, the above described WNCC, metric. With reference to FIG. 1, processor 106 determines an IQM for each printed color design according to the acquired image thereof.

In procedure 286, the sets of control factors exhibiting predetermined respective IQM values are selected. For example the sets of control factors that the respective IQM values thereof are above a predetermined threshold are determined. With reference to FIG. 1, processor 106 the sets of control factors exhibiting predetermined respective IQM values.

Work Flow Example

The color control according to the disclosed technique can be implemented as part of the workflow of a printing press. Reference is now made to FIGS. 7A, 7B and 7C, which are schematic illustrations of workflows, generally referenced 300, 350 and 380 respectively, for controlling color in a printing press, in accordance with another embodiment of the disclosed technique. Workflows 300, 350 and 380 illustrate the various phases of operation of a printing press implementing color control according to the disclosed technique.

With reference to FIG. 7A, workflow 300 is a high-level workflow of a printing press. During workflow 300, spectral reflectance values are measured (e.g., by CMU 104) and images are acquired at phase 302. Spectral measurements and acquired images are employed at various phases of workflow 300 as further elaborated below.

Workflow 300 begins with the job-setup phase 306, in which information relating to the job is acquired. The information relating to the job can either be determined from historical data related to the job or similar jobs or acquired and stored in a database for future reference or both, as indicated in FIG. 7A by the double headed arrow between job setup 304 and historical data 310. The information loaded into the central database may relate to the job in general (i.e., common to all printing stations) or may relate to a specific printing station or color. Information common to all printing stations is for example, Job name, order identification, substrate data, temperature, and humidity (e.g., determined from temperature and humidity sensors). Substrate data relates, for example, to the type of film employed, such as, clear film, white-Ink-backed clear film, white film, paper/carton and the like. Information relating to a specific printing station includes, for example, information relating to the anilox roller, the plate employed for the job, the mounting tape, and the initial viscosity of the ink. Information relating to the anilox roller includes, for example, cell count, cell volume, cell angle. Information relating to the plate includes, for example, the material from which the plate is made, the plate screen, type of screening (e.g., AM or FM screening), shoulder angle or plate curves. Plate screen and plate curves are determined in the Raster Image Processor (RIP). The RIP separates digital representation of the design to be printed (e.g., a pdf image which includes layer of the different color designs), into 1-bit TIFF halftone images that are then used to create the various color plates. The 1-bit TIFFs are employed to calculate the plate screen for each color measurement target location. Information relating to the mounting tape includes, for example, manufacturer name and model number.

Further during the job setup 306 phase, job parameters are defined and determined. These job parameters may be determined from historical data related to the job or similar jobs or determined and stored in a database for future reference or both, as indicated in FIG. 7A by the double headed arrow between job setup 306 and historical data 310. The job parameters are, for example, job name, repeat length, and regions of interest for inspection and color measurement, which are employed during the job run. Also, the reference color characteristics 308 (e.g., the target CIEL*a*b* values) and optionally the tolerances thereof (e.g., $\Delta E_{00}$) are determined and later employed during the job run phase 316. Furthermore, historical data related to the job or similar jobs (e.g., jobs exhibiting similar job parameters within a predetermined tolerance) are searched for within the database. After job setup 306, workflow 300 proceeds to the press initialization phase 312.

During press initialization 312, the pressure settings of all the printing stations in the printing press are determined. Furthermore, the printing stations are registered one with respect to the other. Also, the initial color settings, such as the amount of ink disposed on the web (e.g., as controlled by the ink keys), temperature of the ink, and pH may also be determined. The pressure settings (i.e., distances between the rollers) are determined by varying the anilox pressure and the impression pressure through a range of distances and acquiring an image for each set of distances. The acquired images are analyzed in order to determine the minimum pressure setting (i.e., maximum distance between the rollers) in which a respective acquired image exhibits, for example, a predetermined coverage ratio. The term 'coverage ratio' relates, for example, to the ratio between the area of printed design on the web to the area of a reference image (e.g., as determined according to a pixel count relative to a reference image). During the pressure setup, a plurality of images of the printed color design are acquired (at spectral measurements and image acquisition 302). When press initialization is completed, workflow 300 proceeds to the initial monitoring phase 314.

During initial monitoring 314, the printing job is monitored in order to determine the predictability of the printing job. To that end, a plurality of images and spectral measurements are acquired (at the measuring spectral reflectance values and acquiring images phase 302). From these acquired images and spectral measurements, the IQM and the color quality of the printed designs are determined. Thereafter, the predictability of the IQM and color quality is assured. Herein, the term 'predictability' relates to the manner in which a measured parameter (e.g., IQM or color quality) changes. A parameter is regarded as predictable if the parameter or the average thereof may be described with a selected analytical function (e.g., linear, polynomial, exponential, cyclic and the like). For example, if the average of the parameter exhibits a constant value, then the process which affects this parameter is regarded as stable. When the average of the parameter changes linearly, then the process which affects this parameter is regarded as trending. When the average of the parameter changes cyclically, then the process which affects this parameter is regarded as a cyclic process. In all of these examples (i.e., the stable, the linear and the cyclic processes), the value of the parameter is predictable. The predictability of the IQM and color quality enables to determine if applied changes to control factors shall affect the process in a measurable and predictable manner. It is noted that initial monitoring phase 314 is optional and may be skipped when the printing job is known to be stable and predictable (e.g., from historical data).

After initial monitoring 314, the CfCM and control factors operational range are determined at the CfCM and control factors (abbreviated 'CF' in FIG. 7A) phase 318. The CfCM and control factors operational range may be determined from at least one of historical data related to the job or to similar jobs, or from information acquired during the press initialization phase 312 or the initial monitoring phase 314. Alternatively or additionally, the CfCM and control factors operational range may be determined from acquired measurement of spectral reflectance values designated for this purpose (i.e., measured at the measuring spectral reflectance values and acquiring images phase 302). The determined CfCM and control factors operational range may also be stored for future reference.

During the monitoring the printing process phase 320, the predictability of the job is monitored similar to as described above. To that end, a plurality of images and spectral measurements are acquired (i.e., at the measuring spectral reflectance values and acquiring images phase 302). From these acquired images and spectral measurements, the IQM and the color quality of the printed designs and the predictability thereof are determined. The spectral measurements and acquired images employed during monitoring 320 may be employed for refining (i.e., reducing the residual error) the CfCM and control factors operational range.

After the monitoring the printing process phase 320, the color quality of the printed design is determined at the determining color quality phase 322. The color quality is determined according to the spectral measurements employed during the monitoring the printing process phase 320. As mentioned above, color quality relates to the deviation between the acquired color characteristics (i.e., determined from the spectral measurements made at the measuring spectral reflectance values and acquiring images phase 302) and reference color characteristics. When deviation between the acquired color characteristics and the reference color characteristics exceeds a determined threshold then a correction to the color characteristics of the printed design is required. When a correction to the color characteristics of the printed design is required, the workflow proceeds to the control factor adjustment phase 324. If a correction to the color characteristics of the printed design is not required, the workflow returns to the monitoring the printing process phase 320.

In the control factor adjustment phase 324, a required change to at least one control factor is determined and applied. As mentioned above, the required change to a control factor is determined from the CfCM, by determining the control factors with respective color related information, which results in the reference color characteristics. The control factors with respective color related information, which results in the reference color characteristics is determined according to determined CfCM and control factors operational range. After the control factor adjustment phase 324, the workflow returns to the printing process monitoring phase 320.

With reference to FIG. 7B, workflow 350 depicts exemplary sub-phases of the control factor adjustment phase 324 in workflow 300. Workflow 350 incorporates an informing operator and operator decision phase 356 as further explained below. When a correction to the color characteristics of the printed design is required, a recommended change to at least one control factor is determined at the determining recommended control factor (abbreviated 'CF' in FIG. 7B) adjustment phase 352. As mentioned above, the recommended change is determined by determining the control factors with respective color related information, which results in the reference color characteristics, according to determined CfCM and control factors operational range. After determining recommended control factor adjustment the workflow proceeds to the determining the IQM stability phase 354.

In the determining IQM stability phase 354, the stability of the IQM resulting from the recommended change is determined. The stability of the IQM is determined according to images acquired during initial monitoring phase 314, monitoring the printing process phase 320 and optionally according to historical 310 data as described above. When the IQM is determined to be stable, workflow 350 proceeds to the informing operator and decision phase 356. When the IQM is determined to be unstable, workflow 350 returns to the monitoring the printing process phase 320.

In the informing operator and operator decision phase 356, the operator of the printing press is informed of the recommended change to the at least one control factor. The operator may accept or reject the change (i.e., the operator makes a decision). When the operator accepts the change, workflow 350 proceeds to the adjusting control factor phase 358. When the operator rejects the recommended change, workflow 350 returns to the monitoring the printing process phase 320. Additionally, the operator may be presented with the option of applying the recommended changes to the control factor manually or automatically or completely ignoring the recommendations presented thereto. It is noted that informing operator and operator decision phase 356 is optional and the work flow may be completely automated.

In the adjusting control factor phase 358 the determined change to the at least one control factor is applied as described above and workflow 350 returns to the monitoring the printing process phase 320.

In general, the time elapsed between applying an adjustment to the viscosity control factor (e.g., temperature or amount of pigment-less solvent), until the change in color takes effect, may be longer than the time elapsed between applying an adjustment to pressure until the change in color takes effect. Furthermore, in certain situations it may not be possible to increase the viscosity of the ink. As such adjusting control factors shall be applied in two stages. First, a change in pressure shall be determined. If this change in pressure does not achieve the desired change in color, then a change in viscosity shall be determined. With reference to FIG. 7C, workflow 380 depicts exemplary sub-phases of control factor adjustment phase 324 in workflow 300, where initially, a change in pressure is determined and if this change does not achieve the desired change in color, then a change in viscosity shall be determined.

When a correction to the color characteristics of the printed design is required a recommended adjustment to at least one of impression pressure or anilox pressure is determined at the determining recommended pressure adjustment phase 382. As mentioned above, the recommended adjustment is determined by determining the pressure with respective color related information, which results in the reference color characteristics, according to determined CfCM and control factors operational range.

At the determining IQM stability phase 384, the stability of the IQM resulting from the recommended change is determined. The stability of the IQM is determined according to images acquired during initial monitoring phase 314, monitoring the printing process phase 320 and optionally according to historical data 310 as described above. When the IQM is determined to be stable, workflow 380 proceeds to the informing operator and operator decision phase 386. If the IQM is determined to be unstable, workflow 380 returns to the monitoring the printing process phase 320.

In the informing operator and operator decision phase 386, the operator of the printing press is informed of the recommended change to pressure. The operator may accept or reject the change. When the operator accepts the change, workflow 380 proceeds to the adjusting the pressure phase 388. When the operator rejects the recommended change, workflow 350 returns to the monitoring the printing process phase 320. It is noted that informing operator and operator decision phase 386 is optional and the work flow may be completely automated.

In the adjusting pressure phase 388 the determined adjustment to the pressure is applied as described above and workflow 380 proceeds to determining if the adjustment is sufficient in phase 390.

In the determining if the adjustment sufficient phase 390, if the adjustment is sufficient, workflow 380 returns to the monitoring the printing process phase 320. If the adjustment is not sufficient, workflow 380 proceeds to determining a recommended adjustment to viscosity at phase 392.

At the determining IQM stability phase 394, the stability of the IQM resulting from the recommended change is determined. The stability of the IQM is determined according to images acquired during initial monitoring phase 314, monitoring the printing process phase 320 and optionally according to historical data 310. When the IQM is determined to be stable, workflow 380 proceeds to the informing operator and operator decision phase 386. If the IQM is determined to be unstable, workflow 380 returns to the monitoring the printing process phase 320.

In the informing operator and operator decision phase 396, the operator of the printing press is informed of the recommended change to viscosity. The operator may accept or reject the change. When the operator accepts the change, workflow 380 proceeds to the adjust viscosity phase 398. When the operator rejects the recommended change, workflow 350 returns to the monitoring the printing process phase 320.

In the adjusting viscosity phase 398, the determined adjustment to viscosity is applied as described above and workflow 380 returns to the monitoring the printing process phase 320. It is noted that herein above and below, the terms adjustment and change are employed interchangeably. Furthermore, the terms adjusting and applying a change are also employed interchangeably. Furthermore, informing the operator and operator decisions may be configured to be replaced by automatically applying the changes determined by the software.

It will be appreciated by persons skilled in the art that the disclosed technique is not limited to what has been particularly shown and described hereinabove. Rather the scope of the disclosed technique is defined only by the claims, which follow.

The invention claimed is:

1. A method for controlling color in a printing press, said printing press including at least one printing station printing a respective color design, the method comprising:

a) providing a Control-factor-to-Color Model (CfCM) to control color in the printing press, said CfCM stored in computer memory as at least one of: a look up table (LUT) and a mathematical model, the CfCM accessible to a processor and defining variations in color-related information of a printed design as a function of changes in at least one control factor, said at least one control factor including pressure between rollers in said at least one printing station, said CfCM comprising a correlation of a plurality of control factor values to corresponding color related information, said color related information relating to a set of color characteristics or to information from which the set of color characteristics can be determined, the color characteristics including at least one of spectral reflectance values and coordinates in a color space;

b) printing a first instance of a printed color design on a web;

c) acquiring color characteristics corresponding to said first instance of the printed color design on the web;

d) determining, with the processor, color quality of the first instance of the printed color design; and e) determining, with the processor, from the acquired color characteristics of the first instance of the printed color design that a corrected color characteristic is required;

f) determining, with the processor, a change to at least one control factor within a predetermined control factors operational range by identifying at least one control factor with respective color related information that results in the corrected color characteristic, according to said CfCM, the predetermined control factors operational range defining a range of color factors outside of which a deviation may result in degradation of image quality;

g) applying the determined change to said respective at least one control factor; and h) printing a subsequent instance of the printed color design on the web.

2. The method according to claim 1, wherein said color factors operational range is determined based upon image quality metric values exhibited by acquired images of printed color designs printed at a plurality of control factors values.

3. The method according to claim 2, wherein said determining said control factors operational range includes:

for each printing station, printing the respective color design at a plurality of selected sets of control factors values;

acquiring an image of each printed color design;

determining an image quality metric for each printed color design according to the acquired image thereof; and selecting the sets of control factors exhibiting predetermined image quality metric values.

4. The method according to claim 3, wherein said image quality metric is selected from the group consisting of:

subjective quality factor;

square-root integral;

modulation transfer function; and weighted normalized cross correlation.

5. The method according to claim 3, wherein said respective color design is a set of slur targets.

6. The method according to claim 1 further comprising deriving said CfCM.

7. The method according to claim 6, wherein deriving the CfCM comprises:

for each printing station, printing a plurality of instances of a color design at a plurality of selected sets of control factors values;

acquiring color characteristics corresponding to each printed instance of the color design on the web for each set of control factor values;

for each set of control factor values, determining corresponding color related information respective of each printed instance of the color design;

determining the CfCM according to the sets of control factor values and corresponding color related information.

8. The method according to claim 7, wherein said color space is selected from the group consisting of:

CIEL*a*b*;

CIEL*u*v*;

CIEL*C*H*;

CIEXYZ;

RGB; and

CYMK.

9. The method according to claim 1, wherein said color quality relates to deviation between the acquired color characteristics and reference color characteristics, wherein said color quality metric is at least one of:

ΔE00; and

AEcmc.

10. The method according to claim 1, wherein said determining the change to at least one control factor further includes:

determining stability of an image quality metric to the recommended change.

11. The method according to claim 10, wherein said determining the change to said at least one control factor further includes informing an operator of said change when said image quality metric is determined as stable and receiving operator decision.

12. The method according to claim 1, wherein said at least one control factor further includes viscosity.

13. The method according to claim 1, wherein said change to said at least one control factor is applied by first determining a change in pressure and further determining a change in viscosity when the change in pressure does not achieve desired change in color.

14. The method according to claim 1, wherein said color quality relates to deviation between the acquired color characteristics and reference color characteristics, and said color quality metric comprises spectral distance.

15. The method according to claim 1, wherein steps b)-h) are performed during a press initialization phase of the workflow and during a printing process monitoring phase of a workflow.

16. A system for controlling color in a printing press, said printing press including at least one printing station printing a respective color design, said at least one printing station including at least one pair of printing rollers, the system comprising:

a color measurement unit, for measuring intensity of light reflected from or transmitted through a printed substrate at each of a plurality of spectral ranges over a selected bandwidth;

an actuator interface, for transforming instructions to signals which operate actuators that move the rollers of said at least one printing station;

a processor, coupled with said color measurement unit and with said actuator interface, said processor configured to determine color quality of a printed color design, to determine a required change to at least one control factor when a correction is required, and to send instructions to said actuator interface to cause the actuators to move the rollers to implement said required change, the processor configured to determine said required change by determining the at least one control factor with respective color related information that results in reference color characteristics according to a Control-factor-to-Color-Model (CfCM) within a predetermined control factors operational range defining a range of color factors outside of which a deviation may result in degradation of image quality, the CfCM stored in computer memory as at least one of: a look up table (LUT) and a mathematical model, said CfCM accessible to the processor and defining variations in color related information of a printed design as a function of changes in said at least one control factor, said at least one control factor includes pressure between rollers in said at least one printing station, said CfCM comprising a correlation of a plurality of control factor values to corresponding color related information, said color related information relating to a set of color characteristics or to information from which the set of color characteristics can be determined, the color characteristics including at least one of spectral reflectance values and coordinates in a color space.

17. The system according to claim 16, wherein said at least one control factor further includes viscosity.

18. The system according to claim 17, wherein said processor directs said actuator interface to move at least one of said pair of printing rollers according to the determined change when said at least one control factor includes said pressure between rollers.

19. The system according to claim 17, further including a viscosity controller coupled with said processor, wherein said processor directs said viscosity controller to modify the viscosity of ink employed by said at least one printing station according to the determined change to said respective at least one control factor when said at least one control factor includes said viscosity.

20. The system according to claim 16, wherein said change to at least one control factor being further determined according to a control factors operational range.

21. The system according to claim 16, wherein said color quality relates to deviation between the acquired color characteristics and reference color characteristics, wherein said color quality metric is at least one of:

ΔE00; and

AEcmc.

22. The system according to claim 16, wherein, when said processor determines the required change to at least one control factor, said processor determines a recommended change to said at least one control factor and further determines stability of an image quality metric to the recommended change, wherein said processor further informs an operator of said recommended change when said image quality metric is determined as stable, and wherein said processor receives a decision of said operator.

23. The system according to claim 16, wherein said color quality relates to deviation between the acquired color characteristics and reference color characteristics, and said color quality metric comprises spectral distance.

24. The system according to claim 16, wherein the system is configured to determine the color quality of the printed color design, determine the required change to the at least one control factor, and to send the instructions to the actuator interface during a press initialization phase of the workflow and during a printing process monitoring phase of a workflow.

* * * * *